US011701277B1

(12) United States Patent
Nelson

(10) Patent No.: US 11,701,277 B1
(45) **Date of Patent: *Jul. 18, 2023**

(54) CONFIGURABLE ELEVATED SEAT

(71) Applicant: Liftseat Corporation, Oak Brook, IL (US)

(72) Inventor: Jeffrey Cogan Nelson, Western Springs, IL (US)

(73) Assignee: Liftseat Corporation, Oak Brook, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/879,554

(22) Filed: Aug. 2, 2022

Related U.S. Application Data

(63) Continuation of application No. 17/674,619, filed on Feb. 17, 2022, now Pat. No. 11,439,548.

(51) Int. Cl.
*A61G 5/14* (2006.01)
*A61G 7/10* (2006.01)

(52) U.S. Cl.
CPC ..... *A61G 5/14* (2013.01); *A61G 7/1007* (2013.01); *A61G 2200/34* (2013.01)

(58) Field of Classification Search
CPC ..... A61G 5/14; A61G 7/1007; A61G 2200/34
See application file for complete search history.

(56) References Cited

U.S. PATENT DOCUMENTS

| | | | | |
|---|---|---|---|---|
| 4,884,841 | A * | 12/1989 | Holley | A61G 7/1094 297/331 |
| 5,661,858 | A * | 9/1997 | House | A61G 7/1017 297/DIG. 10 |
| 6,189,164 | B1 * | 2/2001 | Krapu | A61G 7/1094 297/DIG. 10 |
| 6,360,382 | B1 * | 3/2002 | Karash | A61G 7/1017 4/667 |
| 8,056,158 | B2 * | 11/2011 | Henshaw | A61G 7/1007 297/DIG. 10 |
| 8,438,675 | B2 | 5/2013 | Henshaw et al. | |
| 9,393,167 | B2 * | 7/2016 | Ganel | A61G 5/00 |
| 9,662,252 | B1 * | 5/2017 | Pearson | A47K 17/02 |
| 10,932,972 | B1 * | 3/2021 | Bennett | A61G 7/1007 |
| 11,439,548 | B1 * | 9/2022 | Nelson | A61G 5/14 |
| 2010/0219668 | A1 | 9/2010 | Nelson | |
| 2014/0338119 | A1 * | 11/2014 | Henshaw | A61G 5/14 4/667 |
| 2015/0182402 | A1 | 7/2015 | Nelson et al. | |
| 2019/0070052 | A1 * | 3/2019 | Humbert | A47K 13/105 |

* cited by examiner

*Primary Examiner* — Philip F Gabler
(74) *Attorney, Agent, or Firm* — Troy Smith

(57) ABSTRACT

Systems, methods, and devices for seat elevation includes a base and a horizontal seat portion. Vertical supports attached to the seat portion include multiple lift angle holes that allow the seat to be elevated to different lifted angles. Elongate members pivotally connect to vertical supports. The elongate members attach via one of the multiple lift angle holes. The elongate members are able to attach to different lift angle holes. The lifted angle is determined by the first one of the at least two seat position holes. A lift generator is attached to the base and extends to lift the horizontal seat portion into the lifted position. The lift generator contracts to return the horizontal seat portion to the seated position.

18 Claims, 35 Drawing Sheets

100

2100

2100

2100

2100

2100

2100

2100

2100

2100

2100

CONFIGURABLE ELEVATED SEAT

CROSS REFERENCE TO RELATED APPLICATIONS

This application is a continuation of U.S. application Ser. No. 17/674,619, filed Feb. 17, 2022, which is incorporated by reference herein in its entirety.

BACKGROUND

Going to the bathroom is a human necessity. Modern toilets require a person to be able to sit and then to stand. Unfortunately, for many individuals this task is not an easy one. Due to age, injury, or temporary condition, a person may need help in sitting, standing, or both when using a toilet.

DETAILED DESCRIPTION

Various disclosed examples provide a seat that assist an individual in sitting down, standing up, or both. In various examples, the seat is designed to fit around a standing toilet. In these examples, individuals are able to more easily sit down on or stand up from a toilet. Depending on the individual, the amount of help needed is different. Some individuals may need help going from a near vertical standing position to a sitting position. While others may need help going from a squatting position to a sitting position. Accordingly, the angle of the seat when extended is configurable to provided different angles. In various examples, an elevated seat includes configuration options that allows the seat to have different angles from a plane parallel to the floor or base of the seat. In addition, each of the different configurations results in a different path of movement of the seat as it is raised or lowered.

Figure 1:
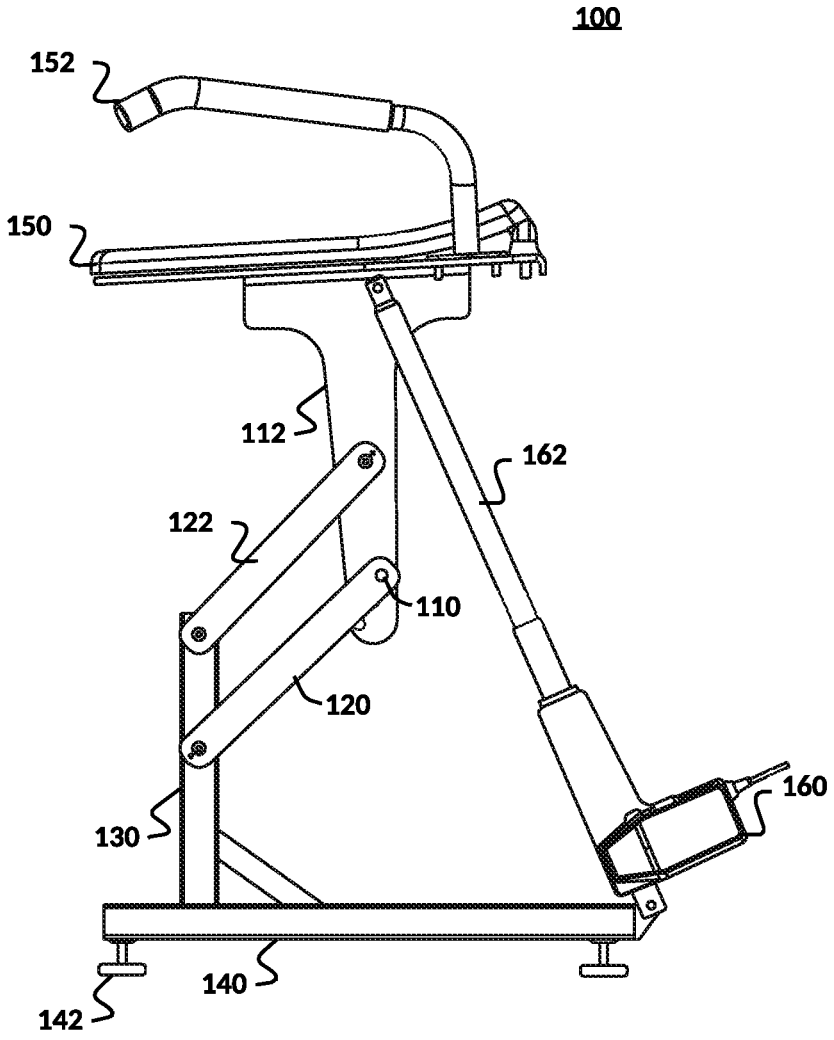
FIG. 1 is a perspective view of an elevated seat in a first configuration in accordance with respective examples.

FIG. 1 is a perspective view of an elevated seat 100 in a first configuration in accordance with respective examples. The elevated seat 100 shown is in its elevated state. The seat 100 includes a base 140. The base 140 may sit on a floor using adjustable feet 142. In other examples, the base 140 may include wheels (not shown). The wheels may include locks which prevents the wheels from moving once the seat 100 has been positioned into place.

The seat 100 includes a seat portion 150. The seat portion 150 is designed for an individual to sit upon. Handles 152 may be included on the seat 100 for added assistance to the individual. The seat portion 150 is connected to the base 140 using various supports. One vertical support 130 is attached to the base 140. Another vertical support 112 is attached to the seat portion 150. A first elongate member 120 connects the two vertical supports together. The first elongate member 120 is pivotally connected to each of the two vertical supports. Thus, when force is applied the seat portion 150 is moved from a sitting position to a lifted position, and vice versa.

The vertical support 112 includes multiple position holes. In some examples, the vertical support 112 has two position holes. In other examples, the vertical support 112 has three, four, five, etc., position holes. In the illustrated example, the first elongate member 120 is attached to position hole 110 on the vertical support 112. The position hole 110 corresponds to a 3-degree lifted angle. The lifted angle is the angle between a plane parallel to the base or floor and the seat portion 150 when the seat is fully lifted. In this example, an individual may sit on the seat portion 150 from a nearly vertical standing position. This example may be useful for individuals that are unable to bend or squat.

The seat 100 may include another elongate member 122. Additional elongate members may be used for added stability in the raising and lowering of the seat portion 150. The elongate member 122 is pivotally connected to the vertical supports 130 and 112. When the seat portion 150 moves, the elongate members rotate. The movement path of the seat portion 150 is different based upon the used position hole. A lift generator 160 is used to apply force to move the seat portion 150. In one example, the lift generator 160 includes a motor that extends or contracts a telescoping arm. In another example, the lift generator 160 exerts a force via an extension portion 162. When a lift force is applied, the extension portion 162 exerts a force on the seat portion 150 causing the elongate members 120 and 122 to move. The path of movement of the seat portion 150 is determined by the position hole 110. The lift generator 160 may also apply a lowering force causing the extension portion 162 to retract and the seat portion 150 to lower. In some examples, the extension portion 162 is attached to the seat portion 150. In other examples, the extension portion 162 may be connected to the vertical support 112.

Figure 2:
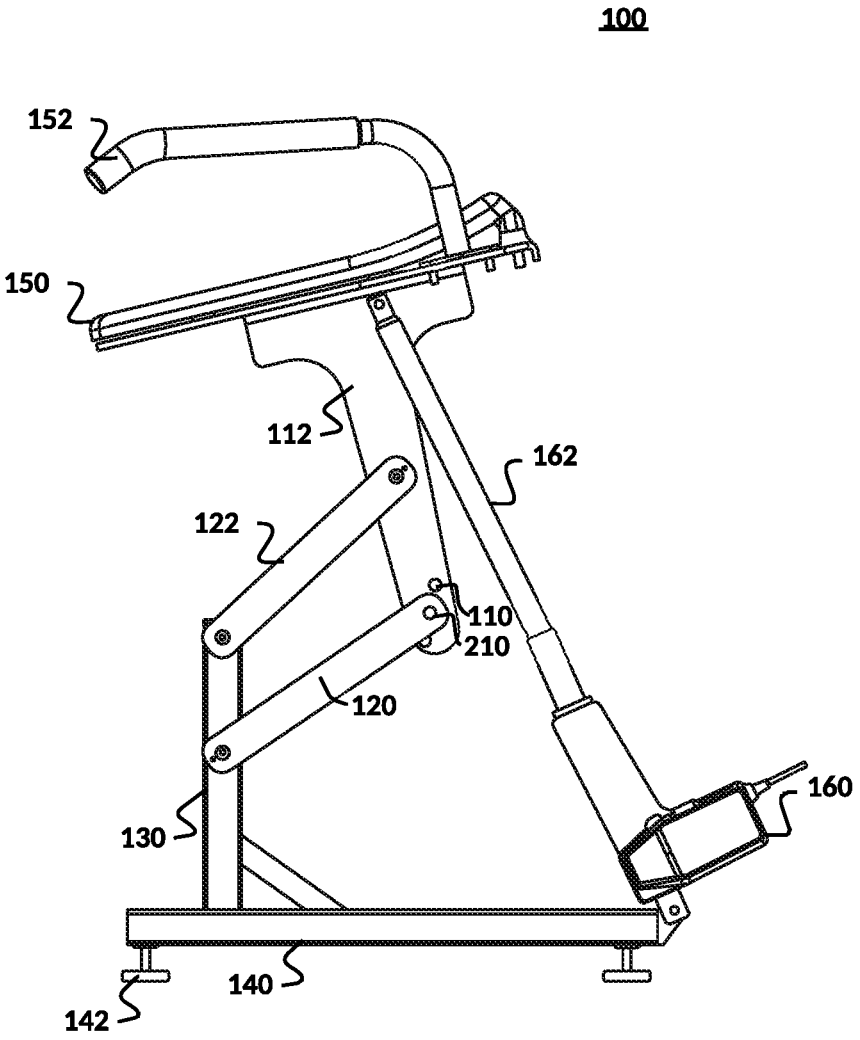
FIG. 2 is a perspective view of an elevated seat in a second configuration in accordance with respective examples.
Figure 3:
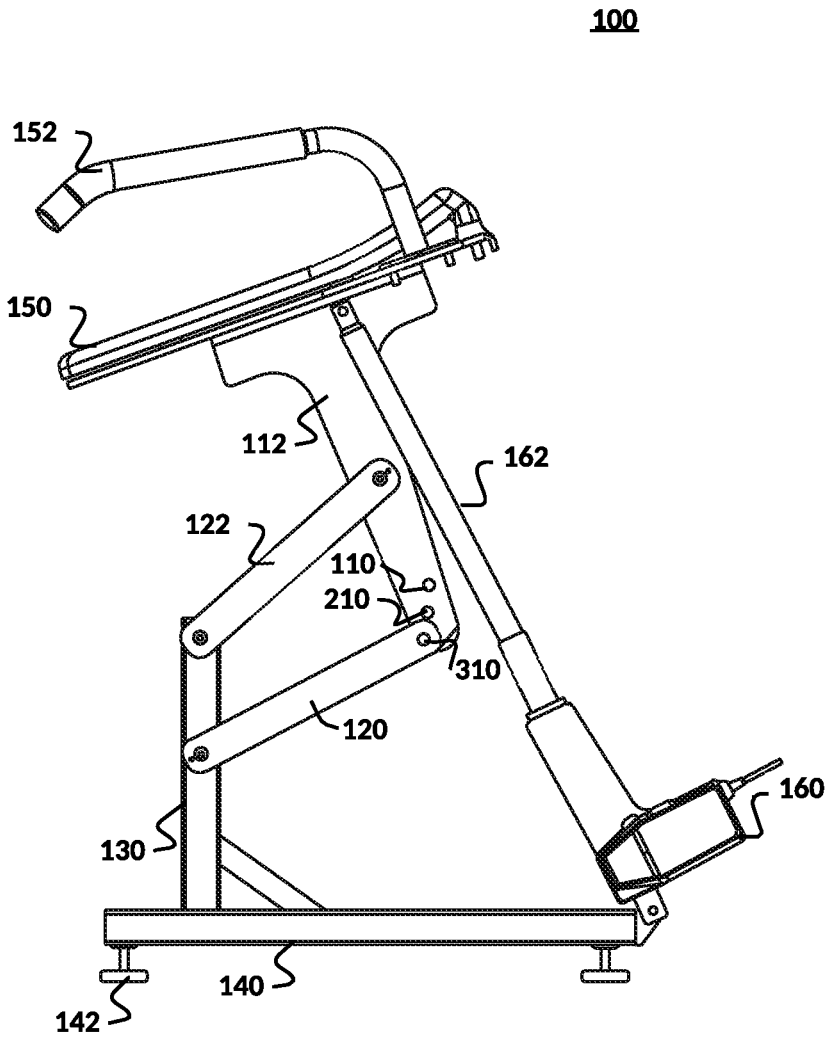
FIG. 3 is a perspective view of an elevated seat in a third configuration in accordance with respective examples.

In various examples, the vertical support 122 may include two or more position holes. In various examples, the position holes allow the lifted angle to vary between 0 degrees to 25 degrees. In one specific example, the seat 100 includes three position holes. The position hole 110 creates a 3-degree lifted angle. FIG. 2 is a perspective view of an elevated seat 100 in a second configuration in accordance with respective examples. In this example, the seat 100 has a lifted angle of 14 degrees based on the elongate member 120 attaching to the vertical support 112 via position hole 210. FIG. 3 is a perspective view of an elevated seat 100 in a third configuration in accordance with respective examples. In this example, the seat 100 has a lifted angle of 20 degrees based on the elongate member 120 attaching to the vertical support 112 via position hole 310. In FIG. 3, the three different position holes 110, 210, and 310, are clearly seen. During installation, the elongate member 120 may be attached to any one of the different position holes. In some examples, the elongate member 120 is attached to the vertical support 112 using a pin, safety pin with locking wiring, etc.

Figure 4:
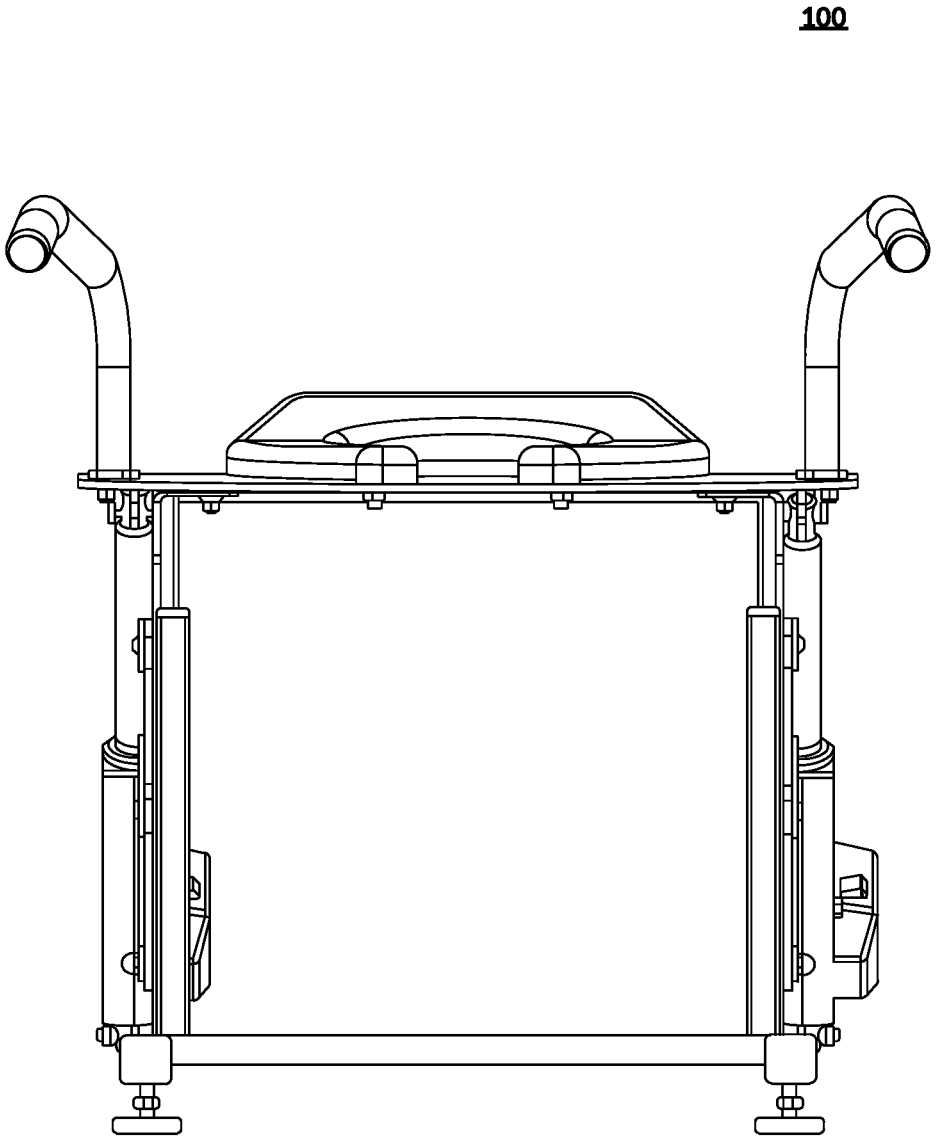
FIG. 4 is a front perspective view of a lowered elevated seat in a second configuration in accordance with respective examples.
Figure 5:
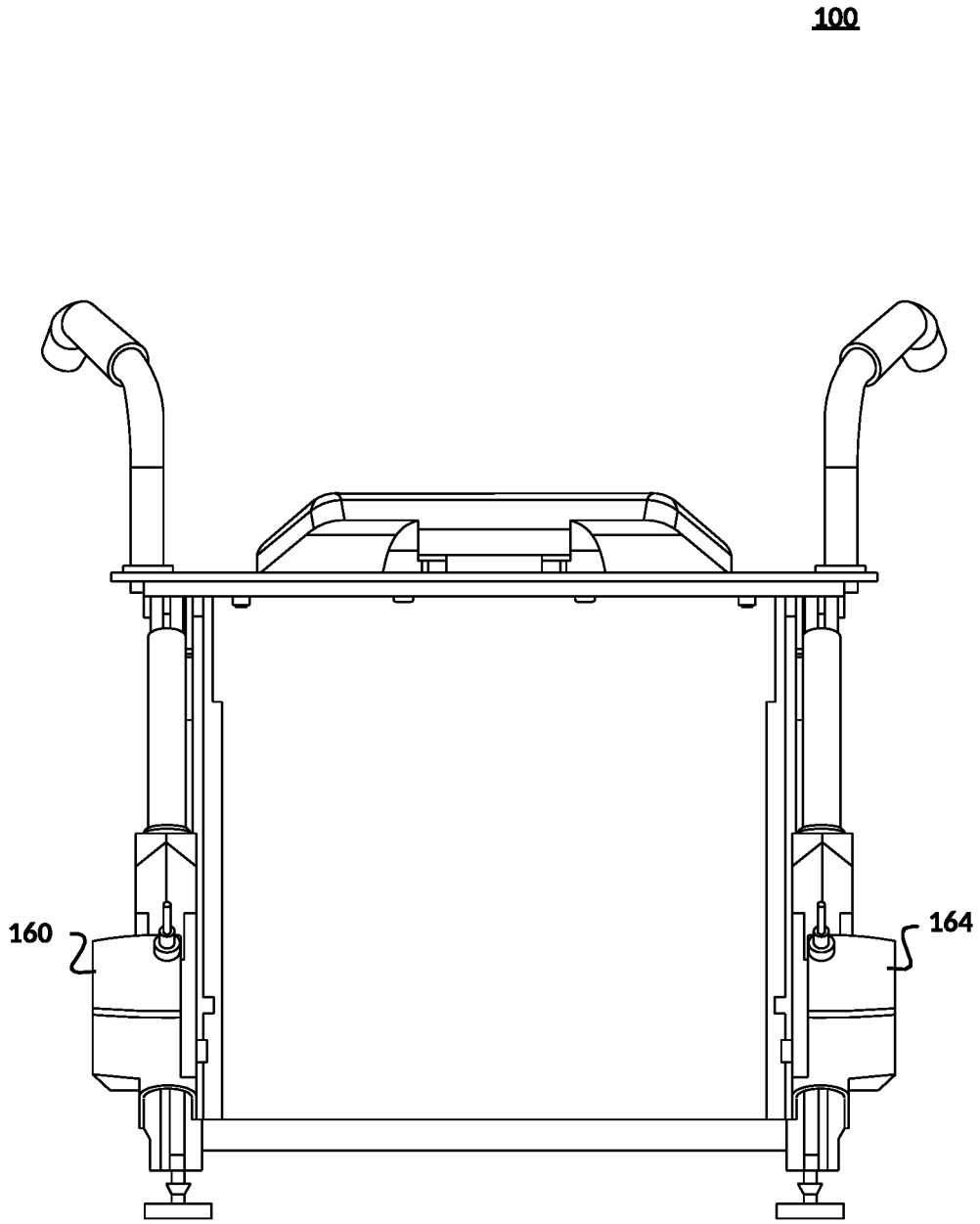
FIG. 5 is a rear perspective view of a lowered elevated seat in a second configuration in accordance with respective examples.

FIGS. 4-9 illustrate various perspectives of a lowered seat in a second configuration in accordance with respective examples. FIG. 4 is a front perspective view of a lowered elevated seat in a second configuration in accordance with respective examples. FIG. 5 is a rear perspective view of a lowered elevated seat in a second configuration in accordance with respective examples. The example seat illustrated in FIG. 5 has two lift generators 160 and 164. In other examples, the seat may have only one lift generator. In these examples, a second extension portion may be installed to allow the other side of the toilet seat to raise. In yet another example, a drive shaft may be connected between the one lift generator and the second extension portion to provide force to the second extension portion. In yet another example, the lift generator may be connected to the upper pivot point of one of the elongate members. A drive shaft may be connected between the pivot points of corresponding elongate members to provide force to the other side.

Figure 6:
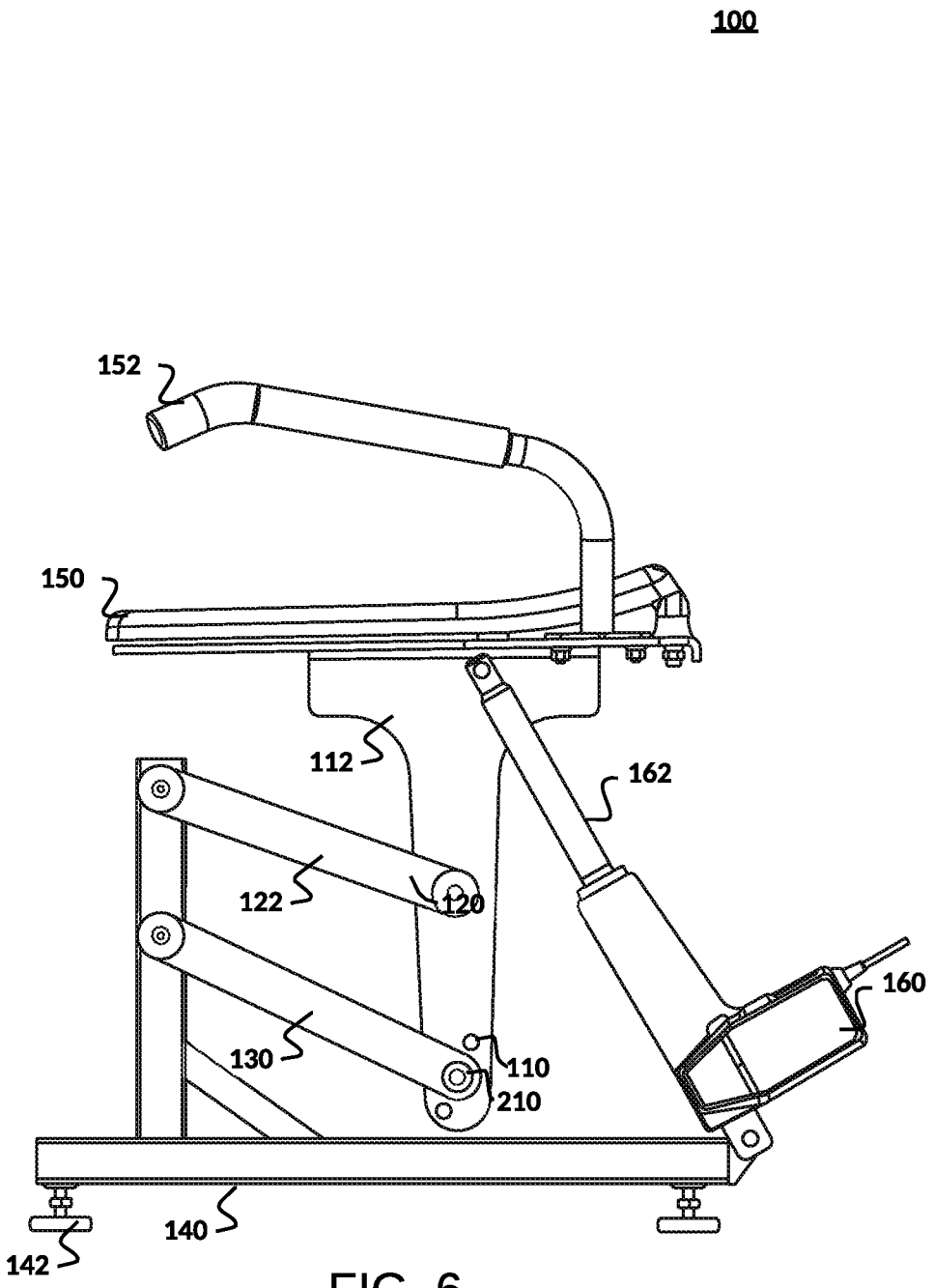
FIG. 6 is a right-side perspective view of a lowered elevated seat in a second configuration in accordance with respective examples.
Figure 7:
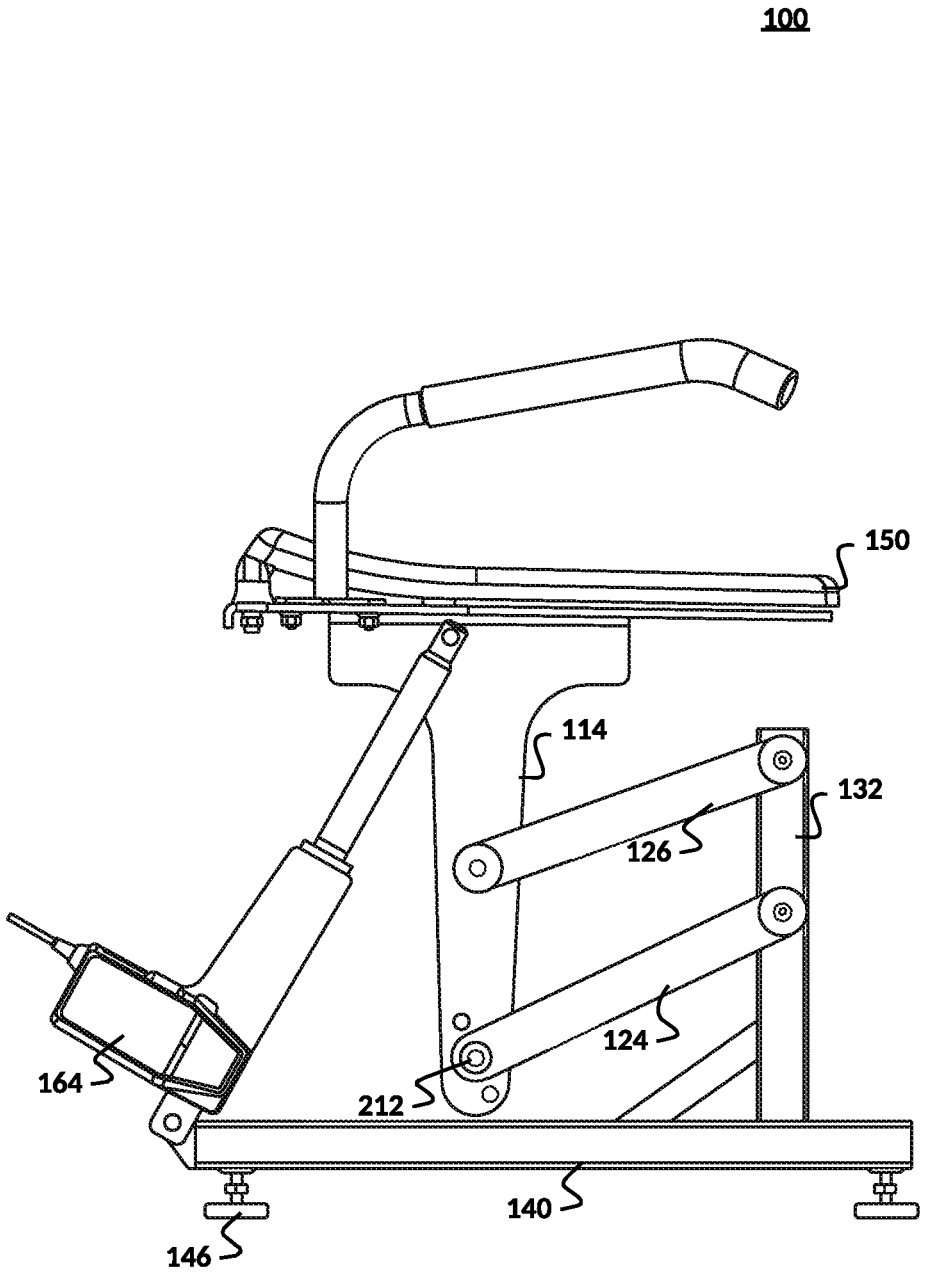
FIG. 7 is a left-side perspective view of a lowered elevated seat in a second configuration in accordance with respective examples.
Figure 8:
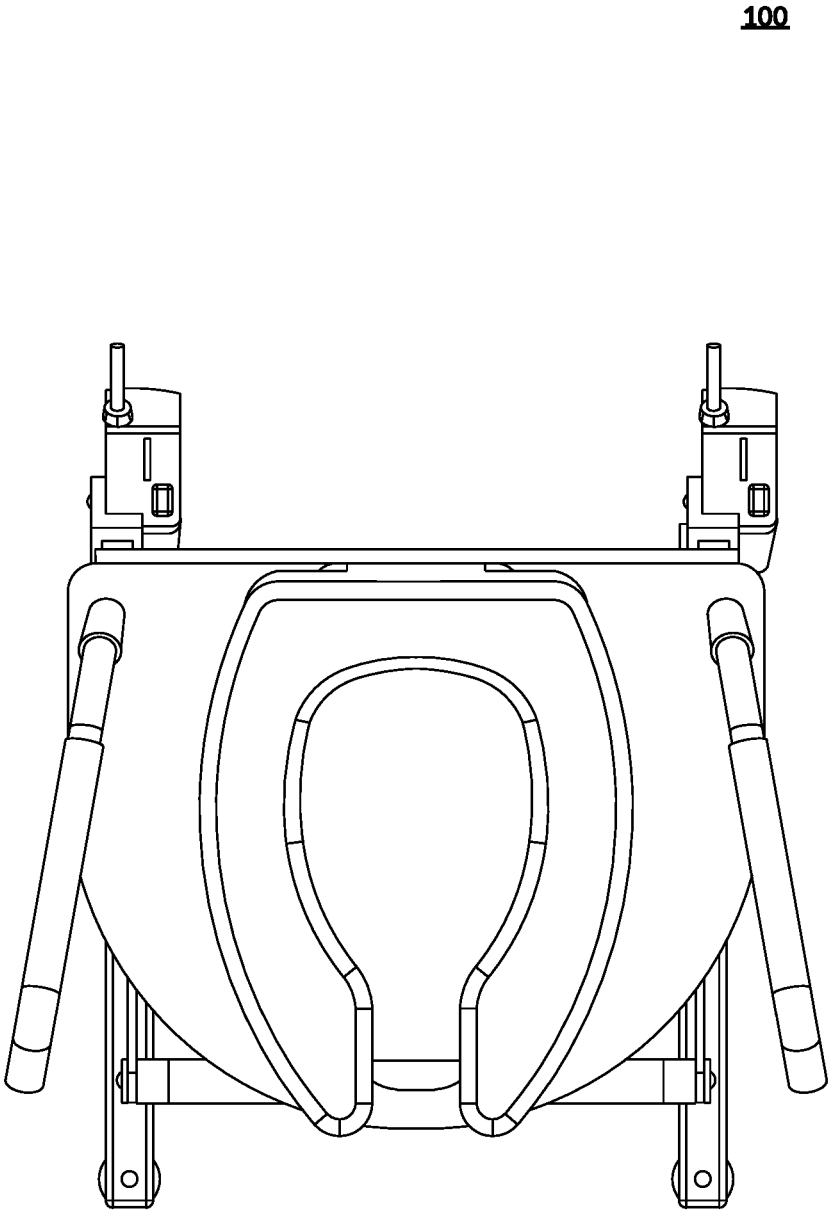
FIG. 8 is a top perspective view of a lowered elevated seat in a second configuration in accordance with respective examples.
Figure 9:
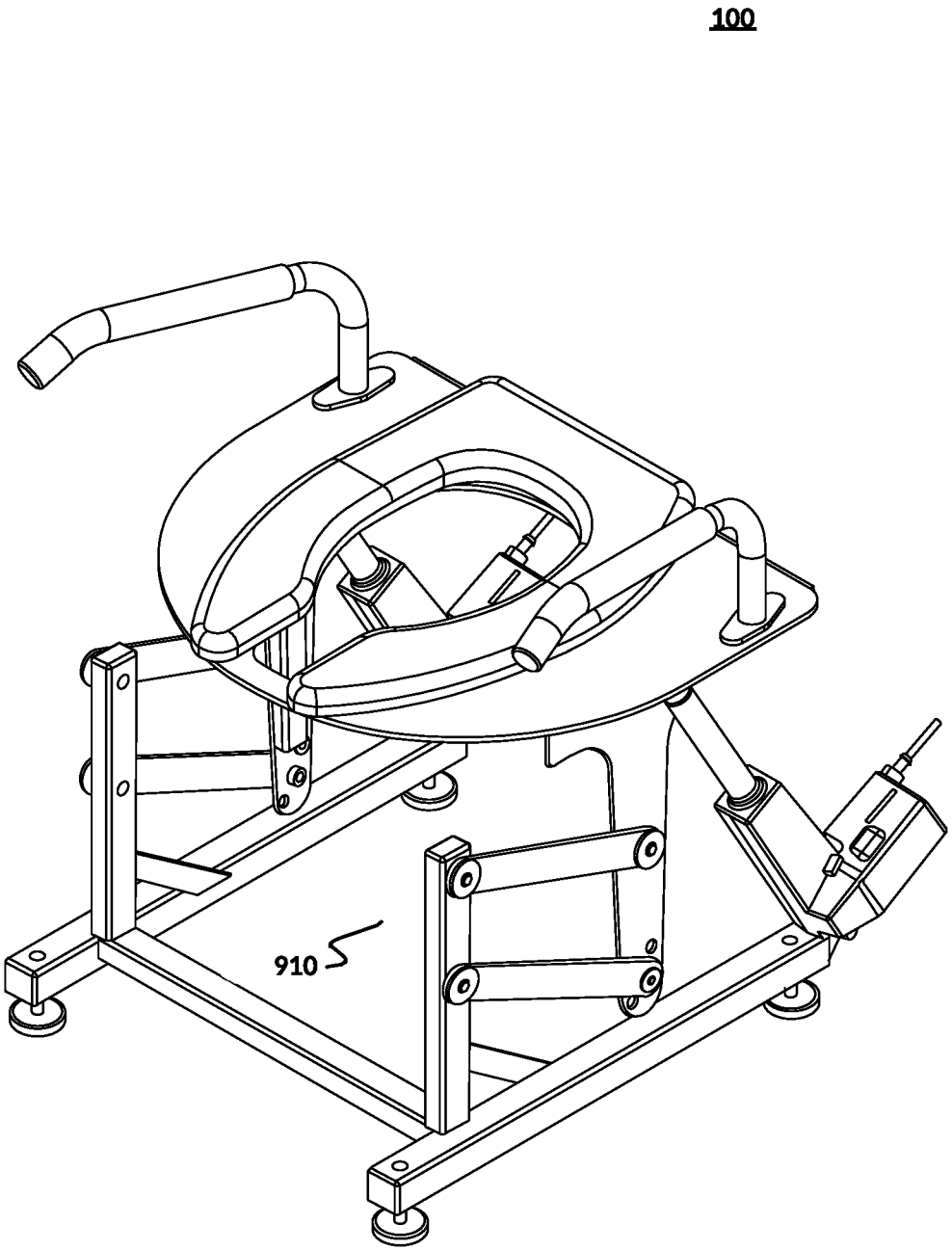
FIG. 9 is a perspective view of a lowered elevated seat in a second configuration in accordance with respective examples.

FIG. 6 is a right-side perspective view of a lowered elevated seat in a second configuration in accordance with respective examples. FIG. 7 is a left-side perspective view of a lowered elevated seat in a second configuration in accordance with respective examples. Comparing the illustrations between FIG. 6 and FIG. 7, corresponding elongate members and vertical supports may be seen. For example, the vertical support 112 has a corresponding vertical support 114 on the other side of the seat. The vertical support 114 also has corresponding position holes, such as 214. Elongate members 124 and 126 correspond with the elongate members 120 and 122, respectively. When properly installed, elongate member 120 and elongate member 124 attach to the vertical supports 112 and 114 via corresponding positional holes, such as 210 and 212. In addition, vertical support 130 corresponds with a vertical support 132 that is attached to the base 140. In some examples, the base consists of at least three components that arrange in the form of a 'U', as seen in FIG. 9. Within the components of the base, the seat portion and the components attached to the base a cavity 910 is formed. The cavity 910 is large enough to allow a toilet to fit within the cavity 910. Installation of the seat, therefore, is achieved by position the seating portion 150 above the toilet bowl.

Figure 10:
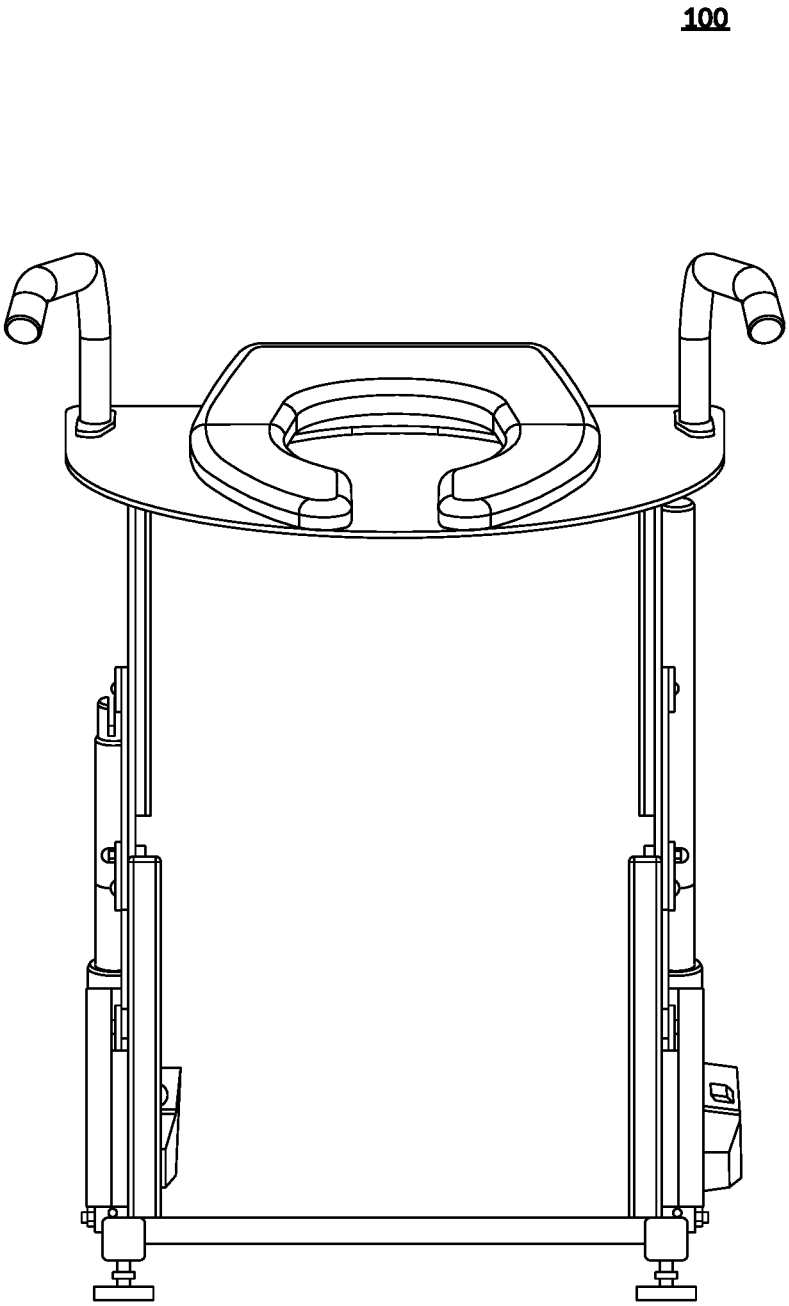
FIG. 10 is a front perspective view of a raised elevated seat in a second configuration in accordance with respective examples.
Figure 11:
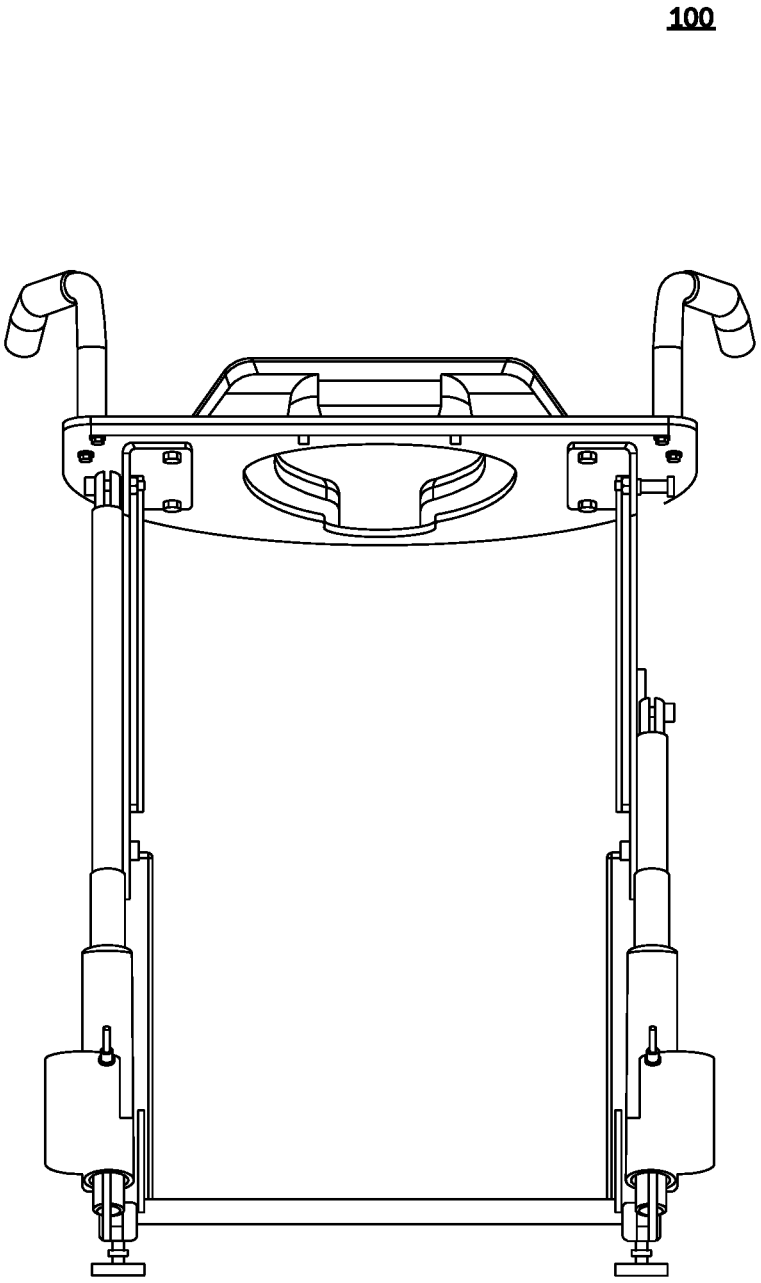
FIG. 11 is a rear perspective view of a raised elevated seat in a second configuration in accordance with respective examples.
Figure 12:
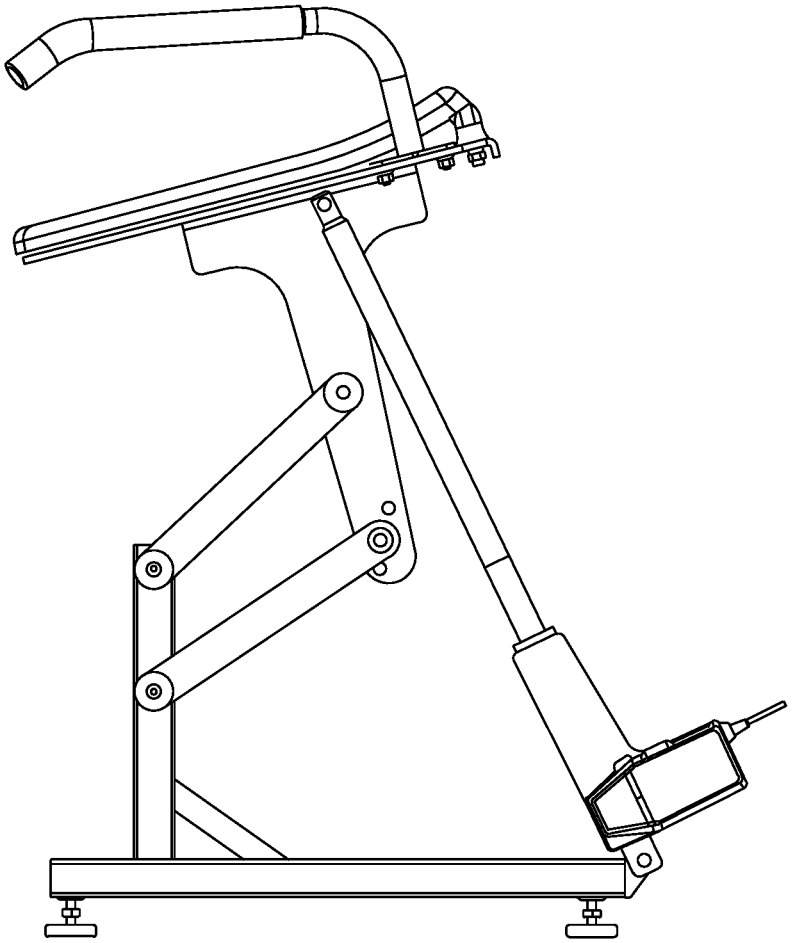
FIG. 12 is a right-side perspective view of a raised elevated seat in a second configuration in accordance with respective examples.
Figure 13:
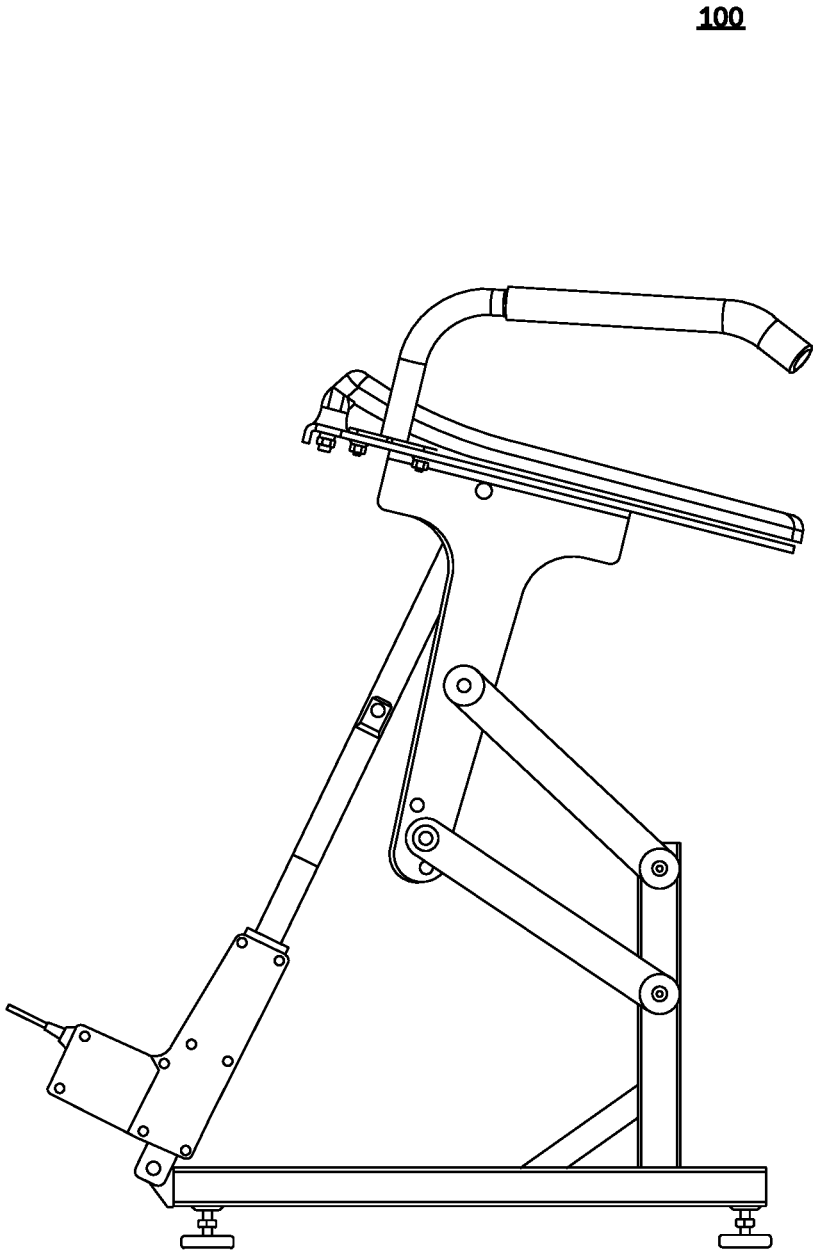
FIG. 13 is a left-side perspective view of a raised elevated seat in a second configuration in accordance with respective examples.
Figure 14:
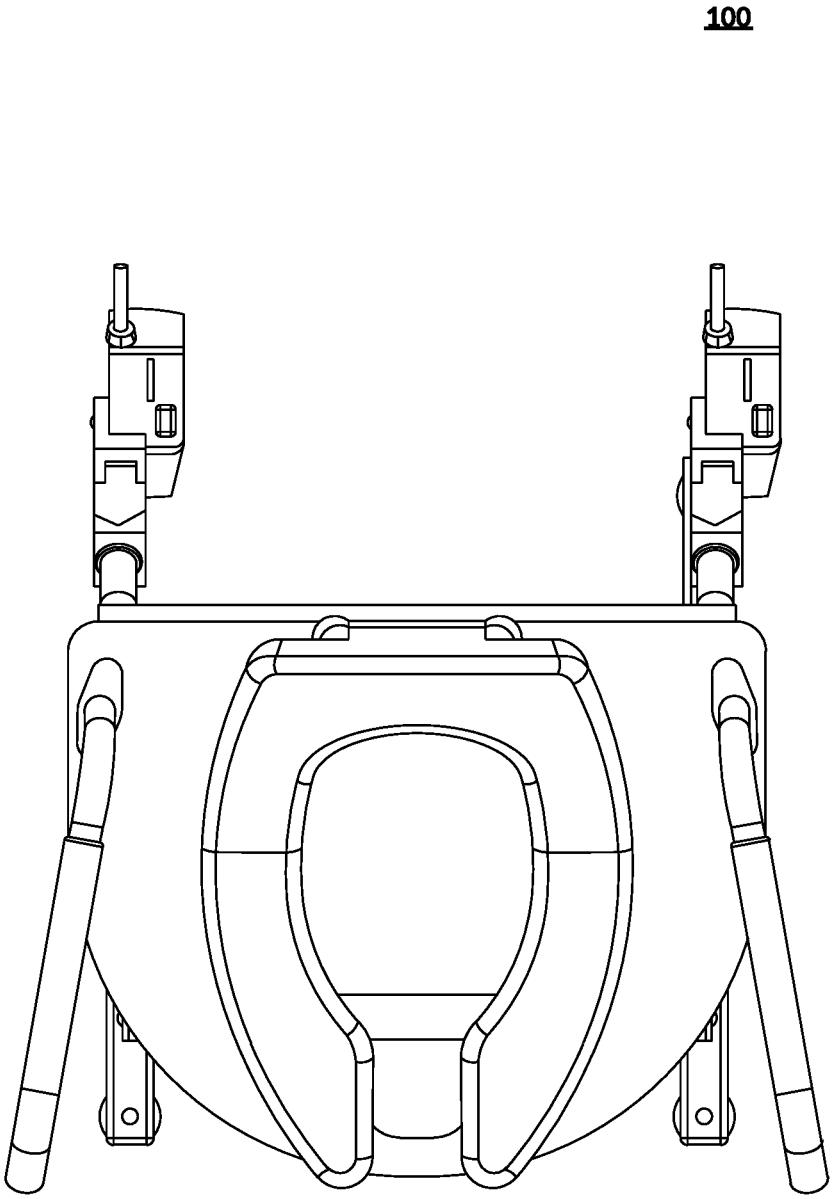
FIG. 14 is a top perspective view of a raised elevated seat in a second configuration in accordance with respective examples.
Figure 15:
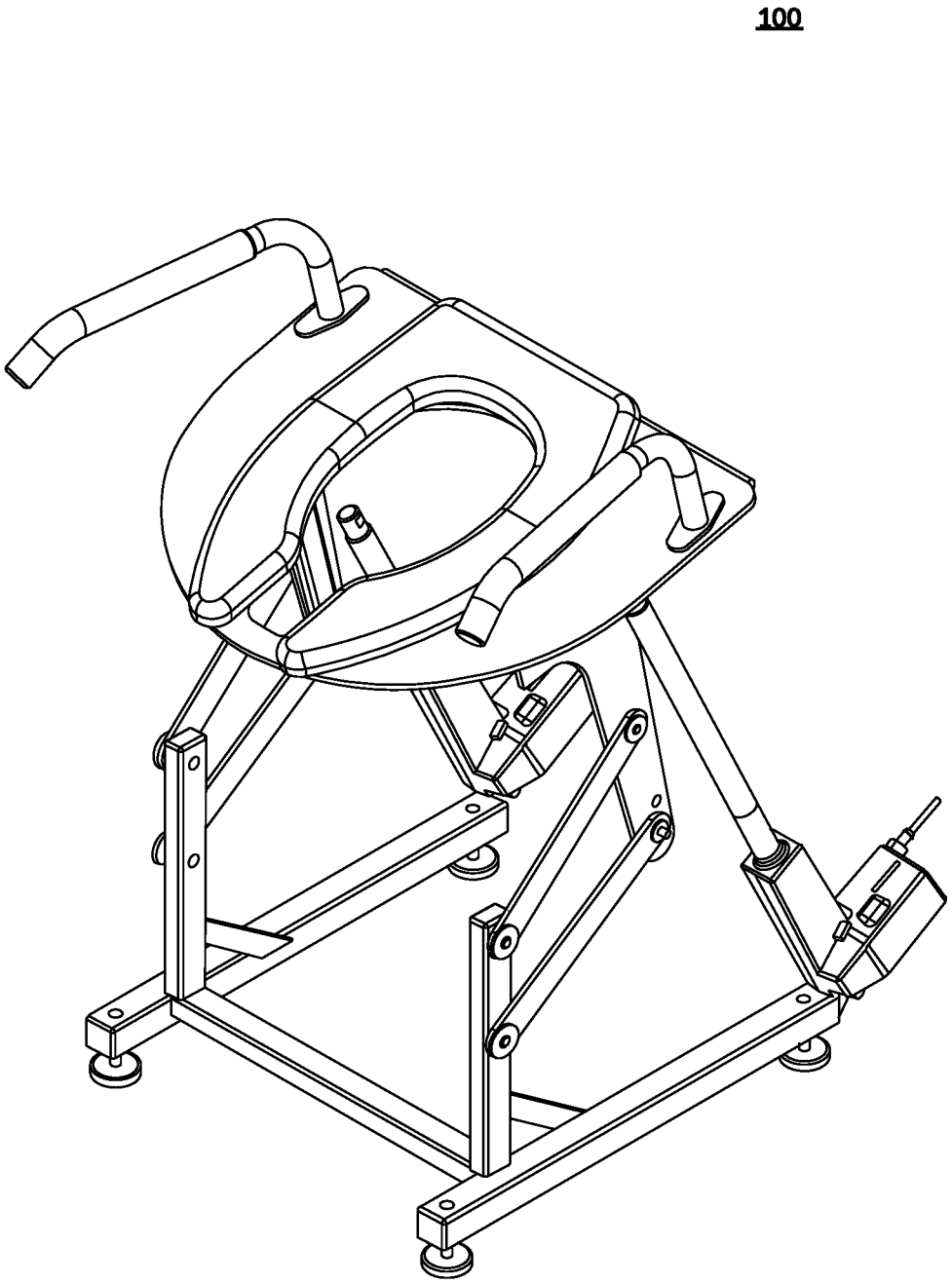
FIG. 15 is a perspective view of a raised elevated seat in a second configuration in accordance with respective examples.
Figure 16:
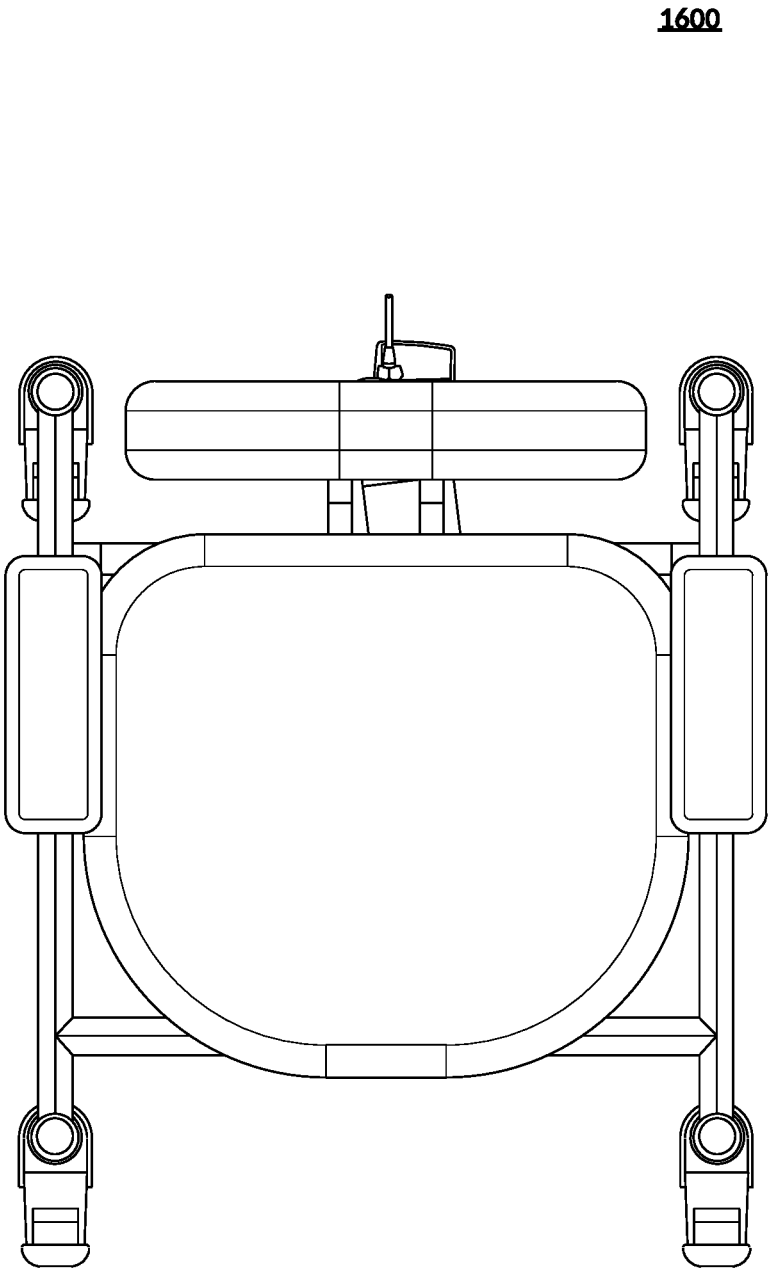
FIG. 16 is a top perspective view of a lowered elevated seat in accordance with respective examples.
Figure 17:
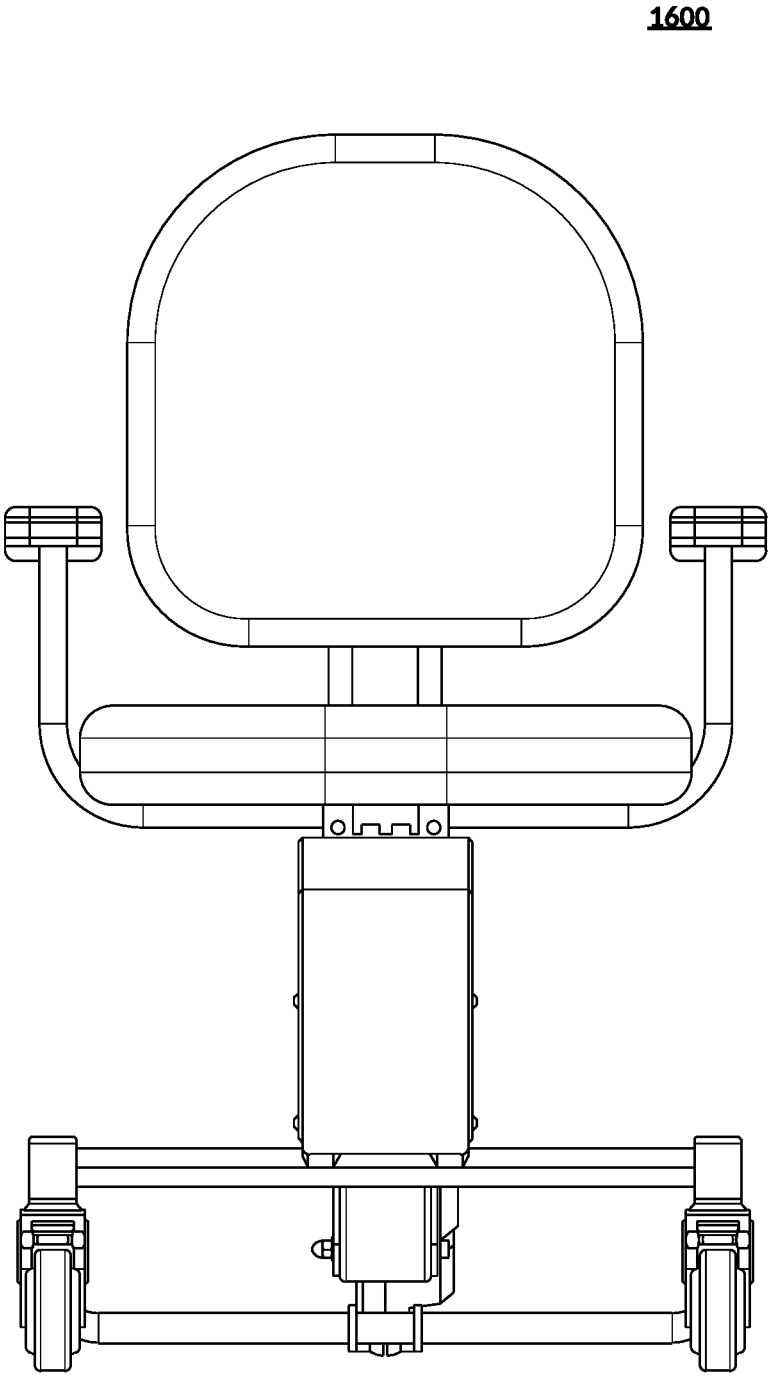
FIG. 17 is a front perspective view of a lowered elevated seat in accordance with respective examples.

FIGS. 10-15 illustrate various perspectives of the elevated seat in a raised position in a second configuration in accordance with respective examples. FIGS. 10 and 15 illustrate the support provided by the seat portion to an individual when the seat is in the raised position. A person may sit down and then lower the seat. Alternatively, when the seat is in the lowered position, the seat may be raised as illustrated in FIGS. 10-15, at which point the person may stand up from the seat portion. In some examples, a control is used to raise and lower the seat. The control may be attached to the seat portion or integrated into one or both of the handles. For example, a raise button may be integrated into one handle and a lower button may be integrated into another handle. As another example, the control may be foot operated. For example, the control may be connected to the base of the seat. The foot control may include two foot-operated controls to raise and lower the seat.

In some examples, the seat may also include a hose configured to attach to the water supply of the toiler. For example, a T-joint may be used to allow water to flow to the toilet as well as to a water sprayer. The water sprayer may be part of a bidet feature of the toilet seat. In other examples, the seat may include a water tank. The hose may then be used to fill a portion of the water tank. The water tank may also include a water heater which heats the water within the tank before the water is used as part of the bidet. In another example, the water heater is used to heat water within the hose prior to being used by the bidet feature. In this example, the seat may be tankless while still providing warm water for the bidet feature.

In another example, the elevated seat may be used in a bed side configuration. In this example, the elevated seat may be used to help a user enter and exit a bed. In this example, a cavity is not required to be present. Accordingly, the lift mechanism may be similar in design to the later discussed office chair examples. In other examples, the cavity may be present. In addition, a bed pan may be installed such that the elevated seat may be used as a bed side toilet. In addition, an arm of the elevated seat may be removed to allow easy access to a bed. For example, the arm between the bed and the seat may be removed. In another example, the arm is not removed but a shorter version of the arm is used. For example, the shorter arm may be connected to the seat at the same location but the length of the arm reduced. Thus, the shorter arm allows a user some support but its reduced length allows easier access to the bed.

Figure 18:
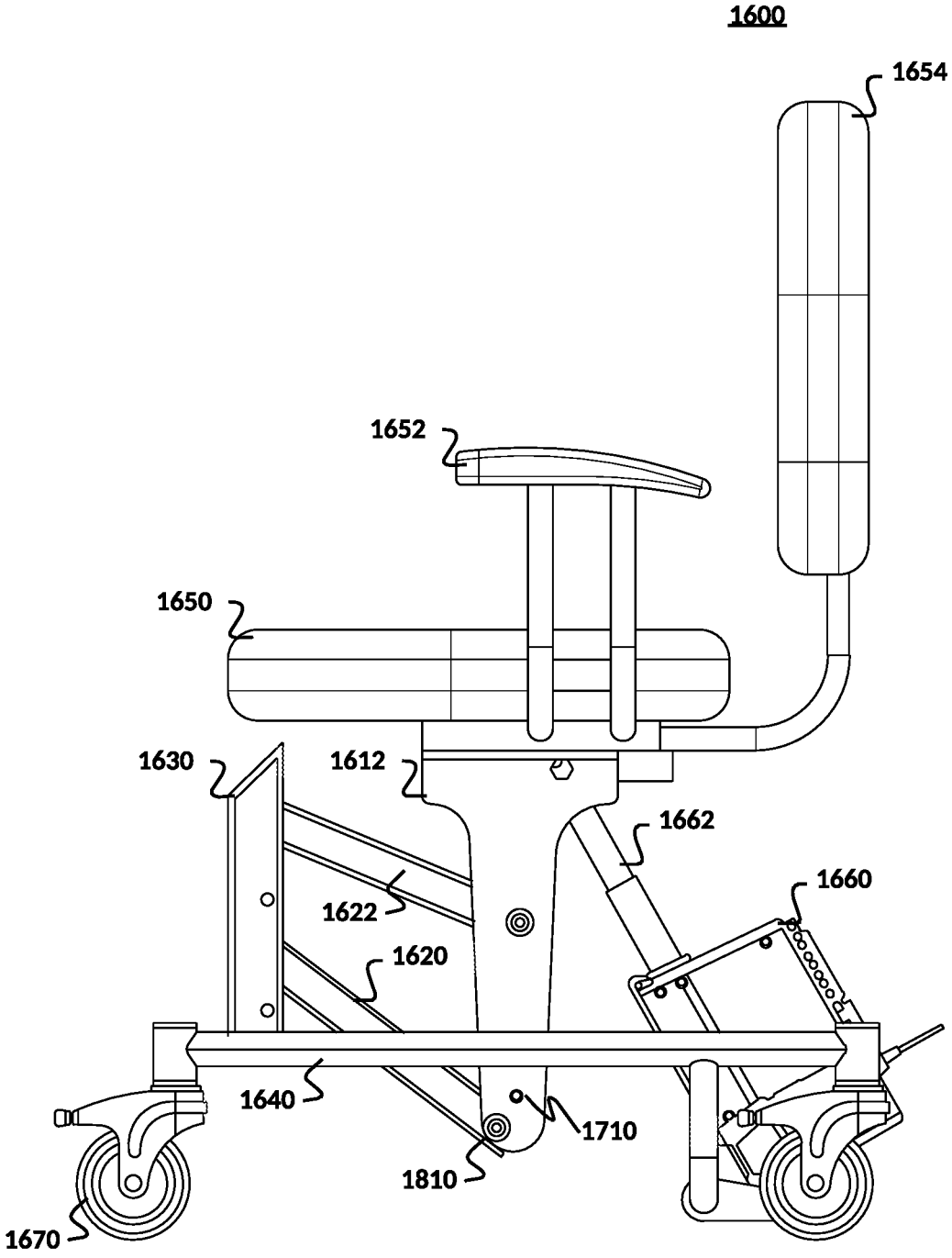
FIG. 18 is a side perspective view of a lowered elevated seat in accordance with respective examples.

In another example, the elevated seat is used as a chair. For example, the chair may be an office chair, a dining chair, etc. The disclosed examples include the multiple position holes, that allow configuration of the path of movement of the seat. FIGS. 16-20 illustrate various perspectives of a lowered seat in accordance with respective examples. FIG. 18 illustrates a side perspective view of a lowered elevated seat 1600. Similar to the seat 100, the seat 1600 includes a seat portion 1650 and one handle 1652 of a pair of handles. The seat 1600 also includes a back 1654. The seat 1660 is able to be moved to an elevated position as shown in later figures. The movement path of the seat portion 1650 is configurable based on the use of one of multiple position holes. In FIG. 18, the position hole 1810 is being used. The position hole 1810 is used to connected to a first elongate member 1620.

The seat 1600 also includes a vertical support 1630 and another vertical support 1612. The vertical support 1630 connects to a base 1640. Also attached to the base are four wheels, such as wheel 1670. Two or more wheels may include locking mechanisms that prevent the wheels from moving when the seat is positioned. In other examples, the seat may only contain two wheels, such as two wheels at the back of the seat and two positioning elements at the front, or vice versa. In various embodiments, a lift generator 1660 may also be attached to the base 1640. The lift generator 1660 may include an extension portion 1662 that connects to the lift generator 1660 and to the bottom of the seat portion 1650 or to the vertical support 1620.

The vertical support 1612 may be attached to the seat portion 1650. Elongate members 1620 and 1622 connect the two vertical supports 1612 and 1630 together. The elongate members 1622 and 1620 may attach to the vertical support 1612 in a pivot fashion and to the vertical support 1630 in a fixed fashion. Accordingly, when force is applied by the lift generator 1660, the seat portion 1650 moves from a lowered position to a raised position. The movement path taken by the seat portion 1650 depends upon which position hole 1810 is used to attach the elongate member 1620 to the vertical support 1612. The lift generator 1660 may also provide force to constrict the extension portion 1662 such that the seat 1660 moves back into a lowered position.

Figure 19:
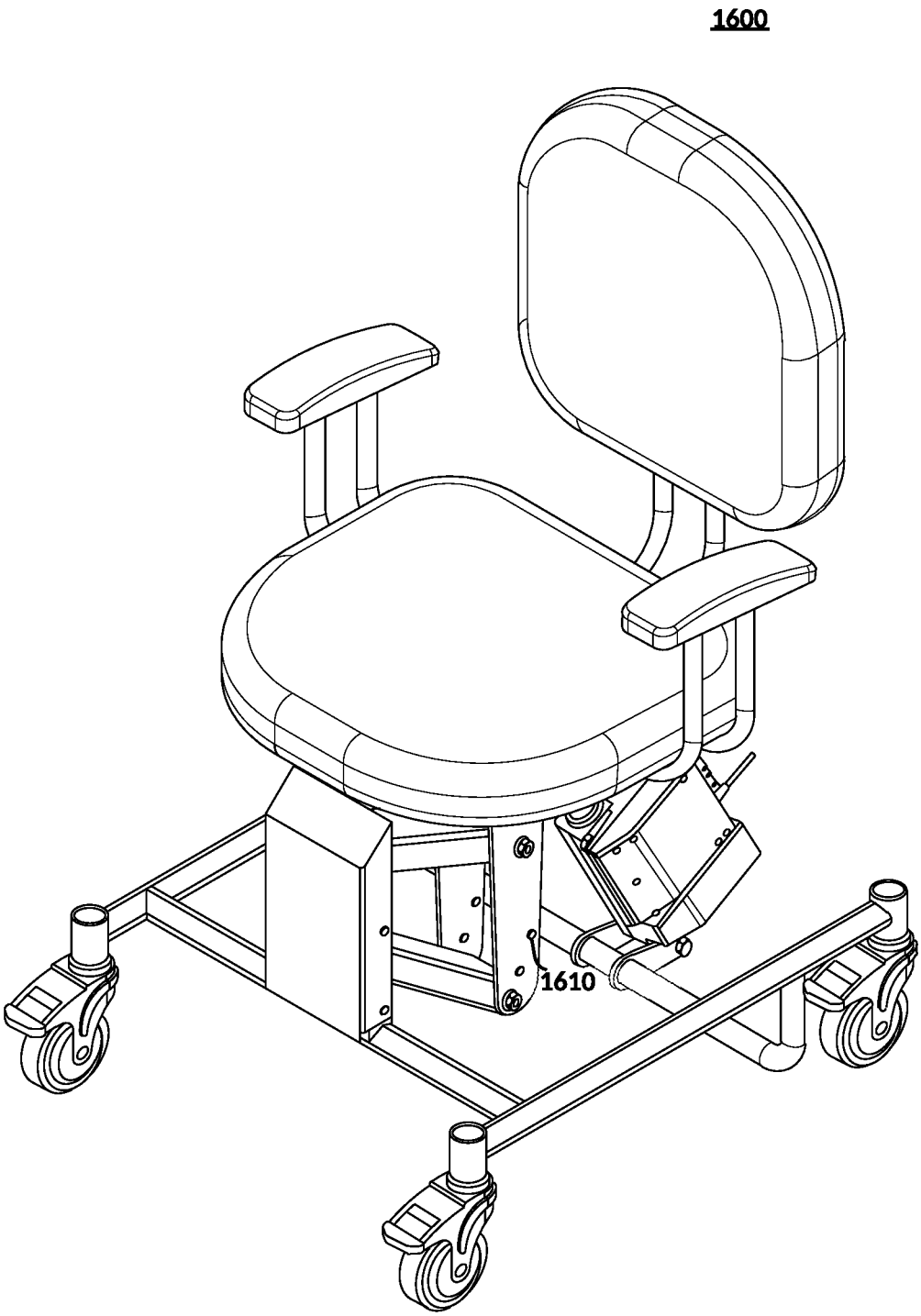
FIG. 19 is a perspective view of a lowered elevated seat in accordance with respective examples.
Figure 20:
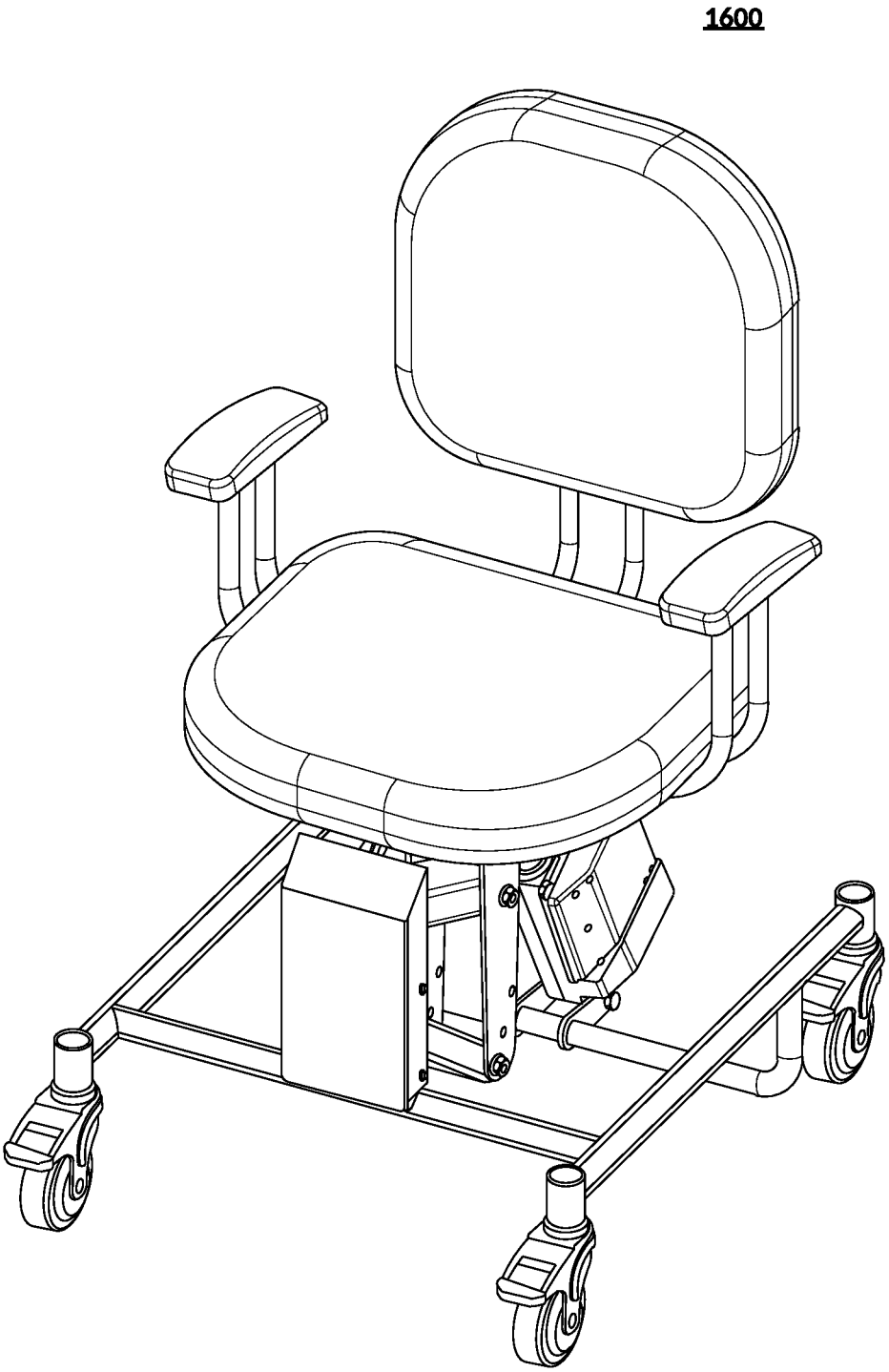
FIG. 20 is a perspective view of a lowered elevated seat in accordance with respective examples.
Figure 21:
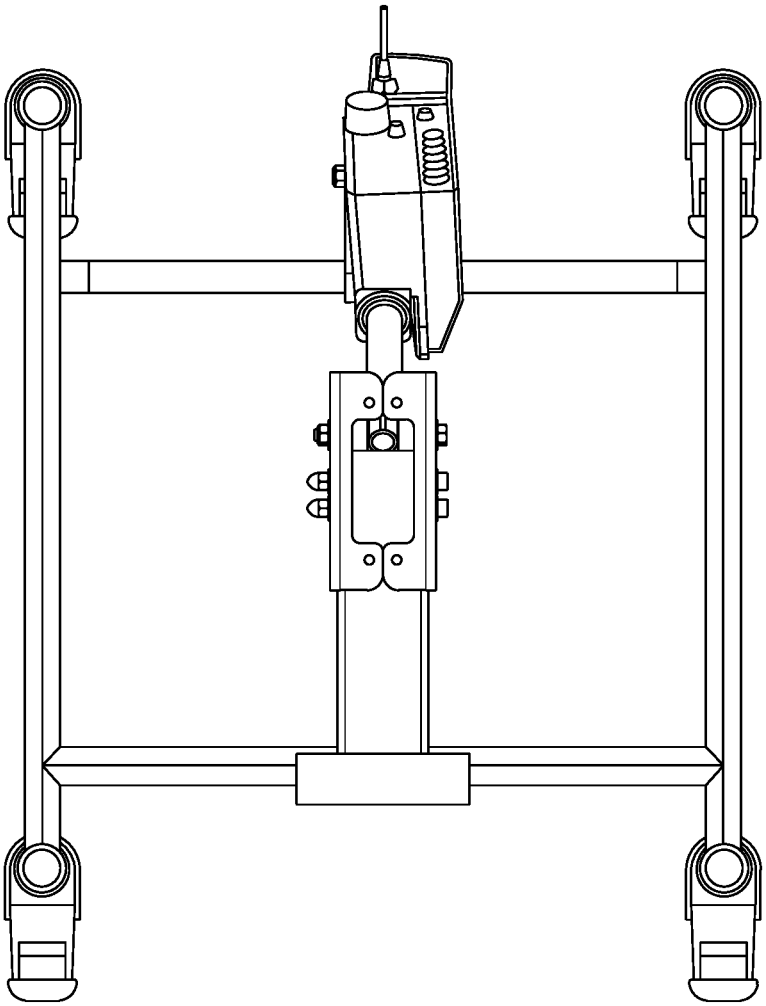
FIG. 21 is a back perspective view of a lowered bottom portion of an elevated seat in accordance with respective examples.
Figure 22:
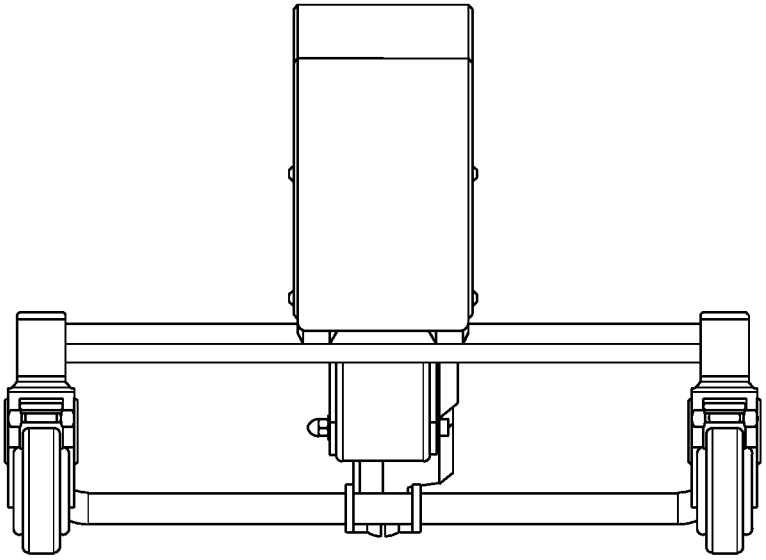
FIG. 22 is a front perspective view of a lowered bottom portion of an elevated seat in accordance with respective examples.
Figure 23:
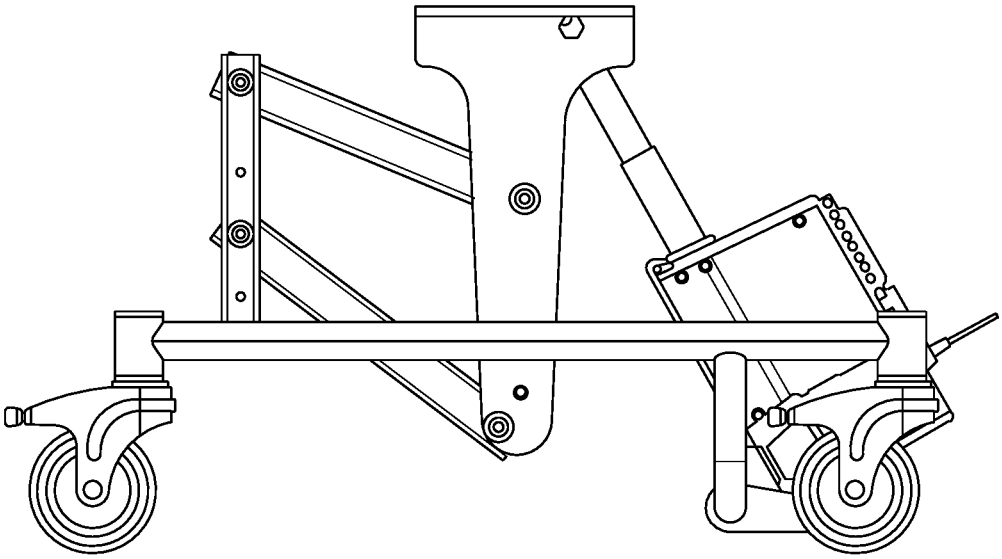
FIG. 23 is a side perspective view of a lowered bottom portion of an elevated seat in accordance with respective examples.
Figure 24:
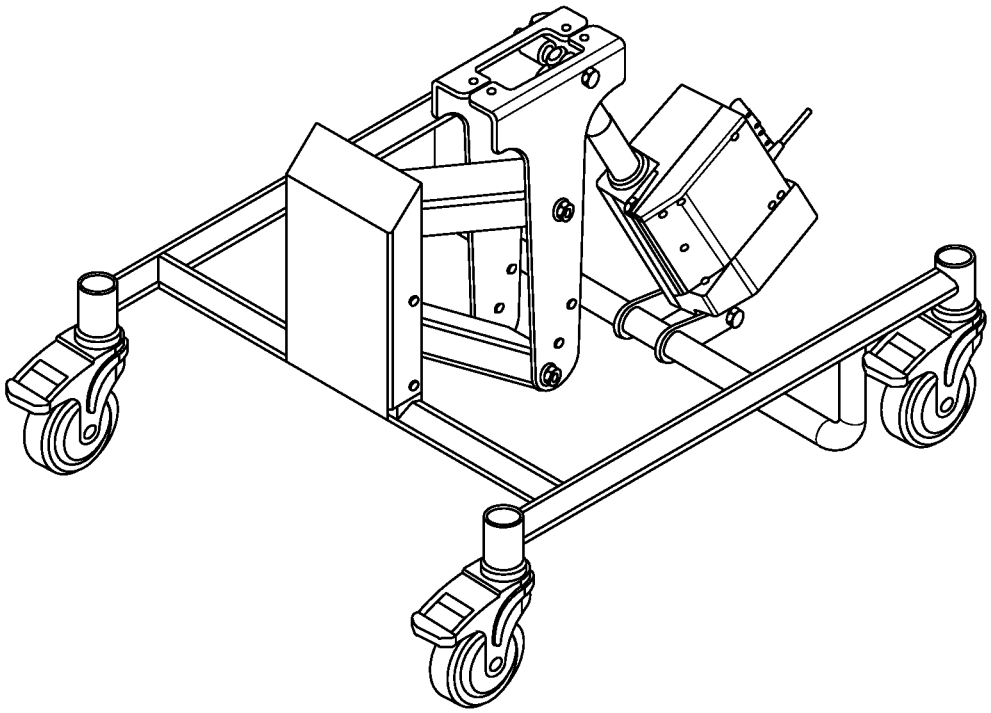
FIG. 24 is a perspective view of a lowered bottom portion of an elevated seat in accordance with respective examples.
Figure 25:
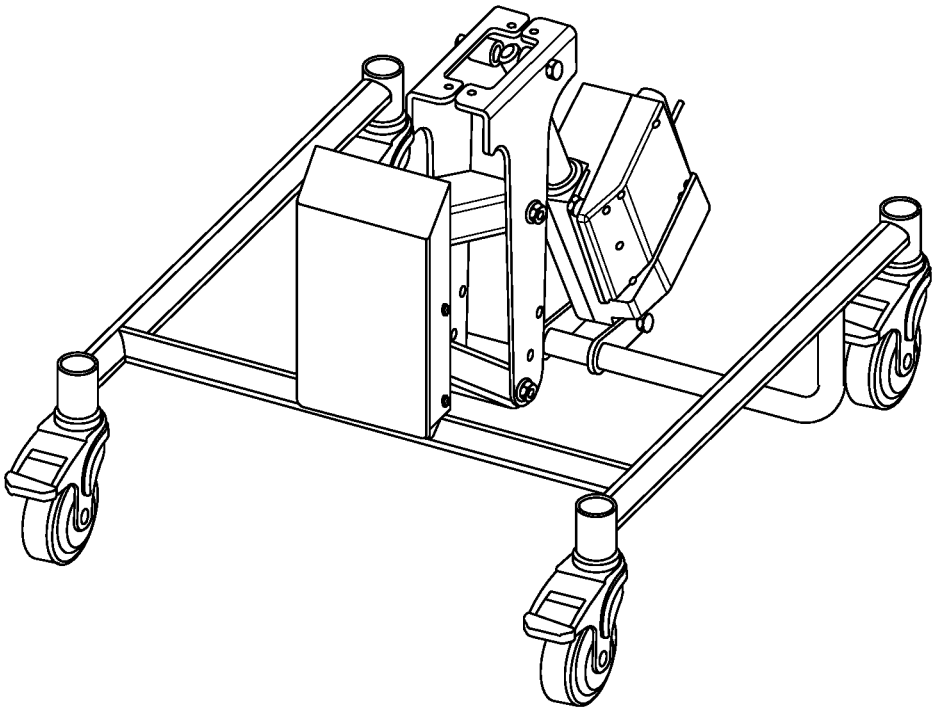
FIG. 25 is a perspective view of a lowered bottom portion of an elevated seat in accordance with respective examples.
Figure 26:
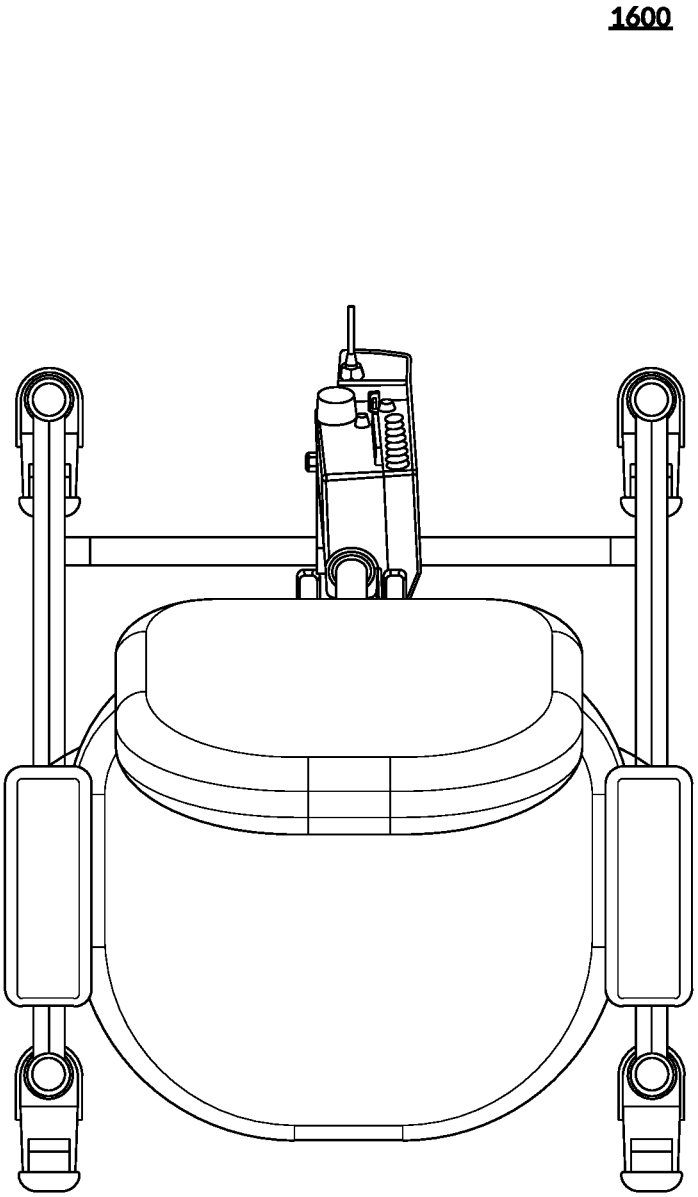
FIG. 26 is a top perspective view of a raised elevated seat in in accordance with respective examples.
Figure 27:
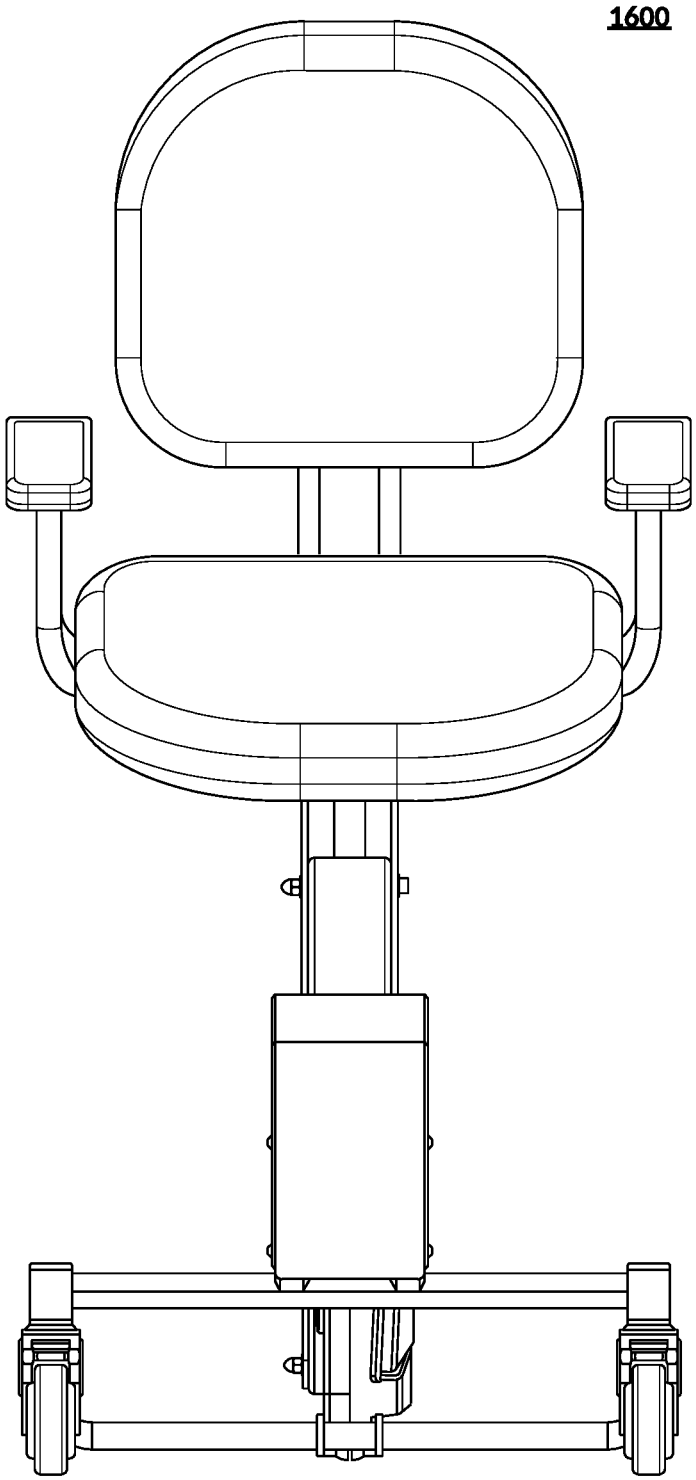
FIG. 27 is a front perspective view of a raised elevated seat in accordance with respective examples.
Figure 28:
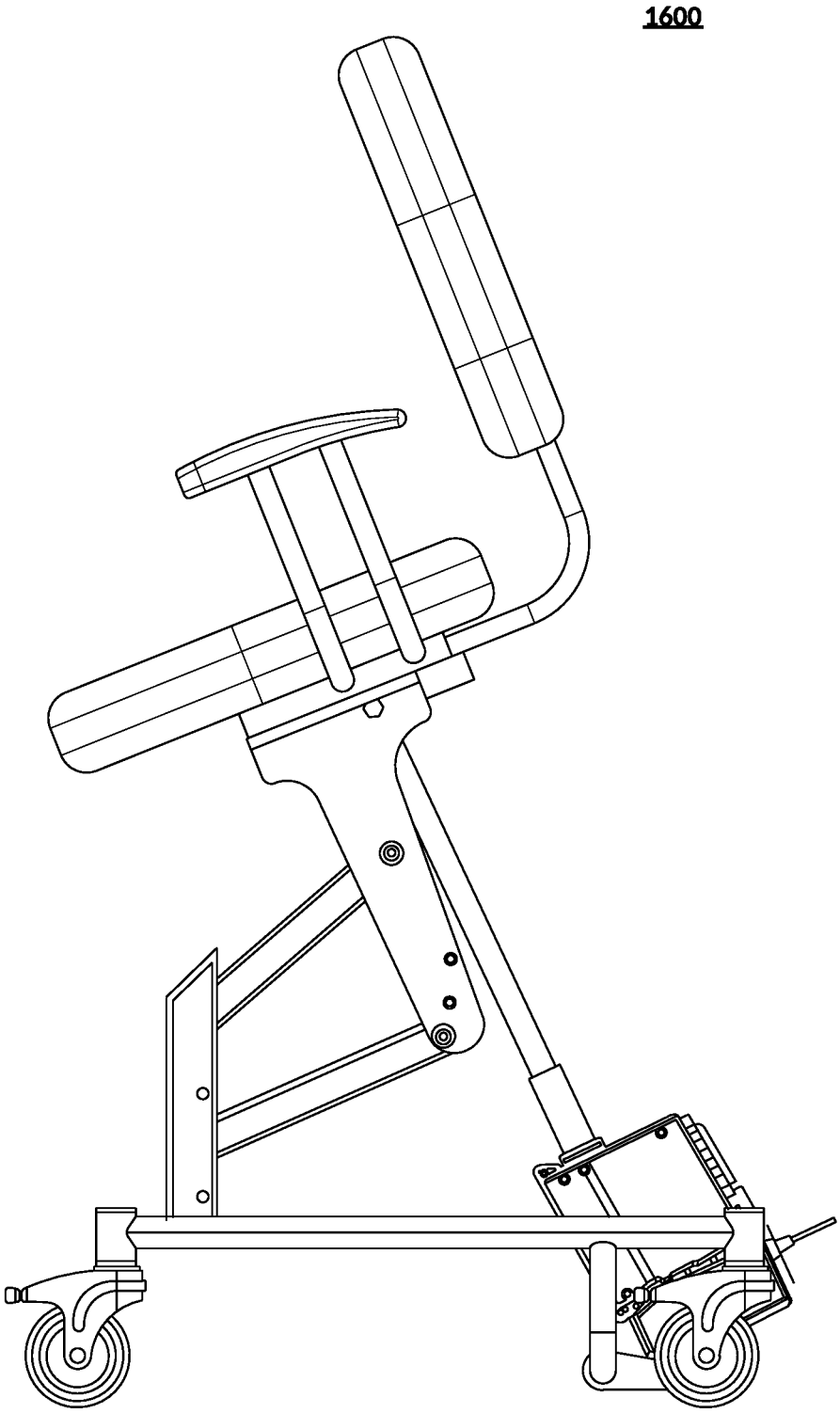
FIG. 28 is a side perspective view of a raised elevated seat in accordance with respective examples.
Figure 29:
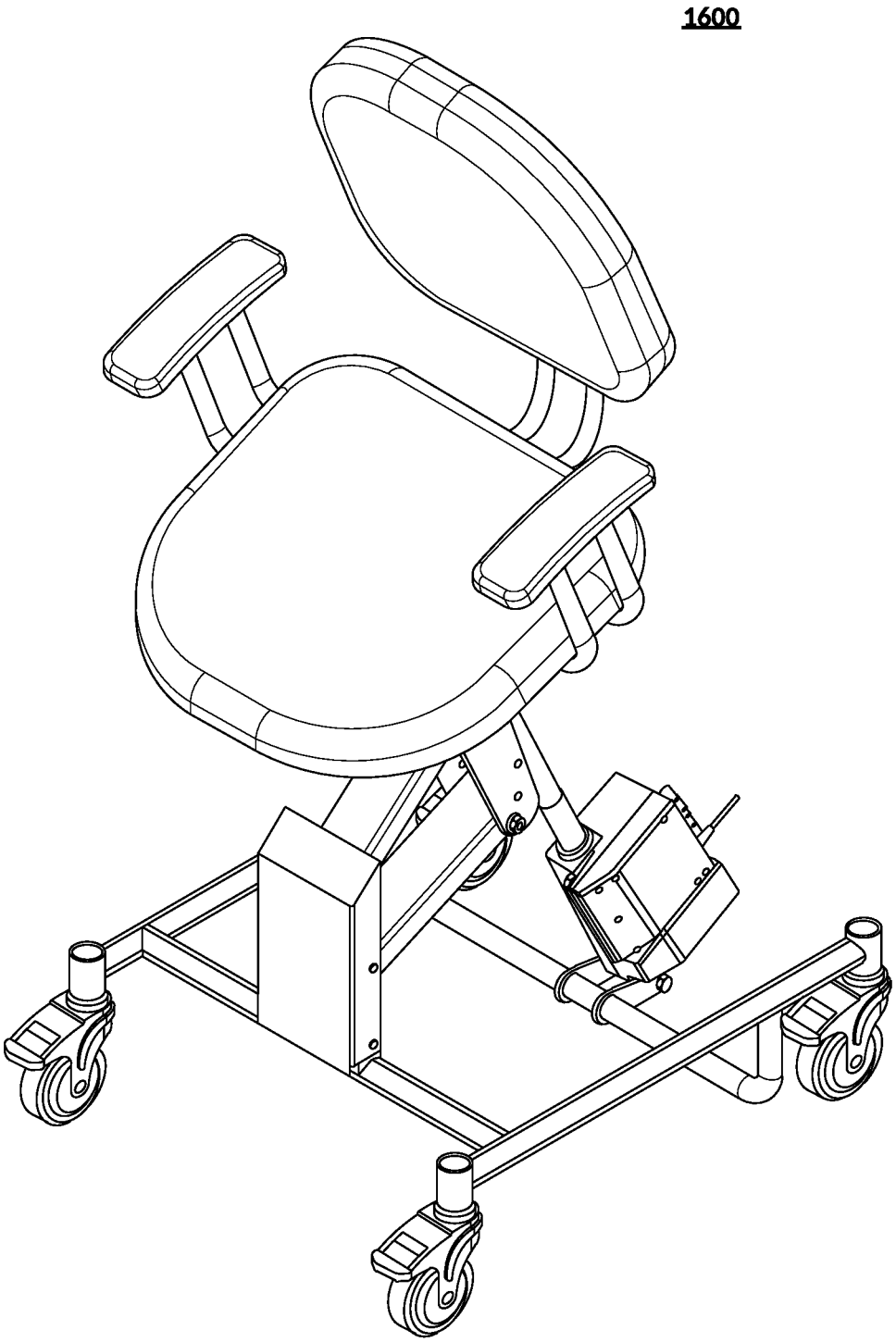
FIG. 29 is a perspective view of a raised elevated seat in accordance with respective examples.
Figure 30:
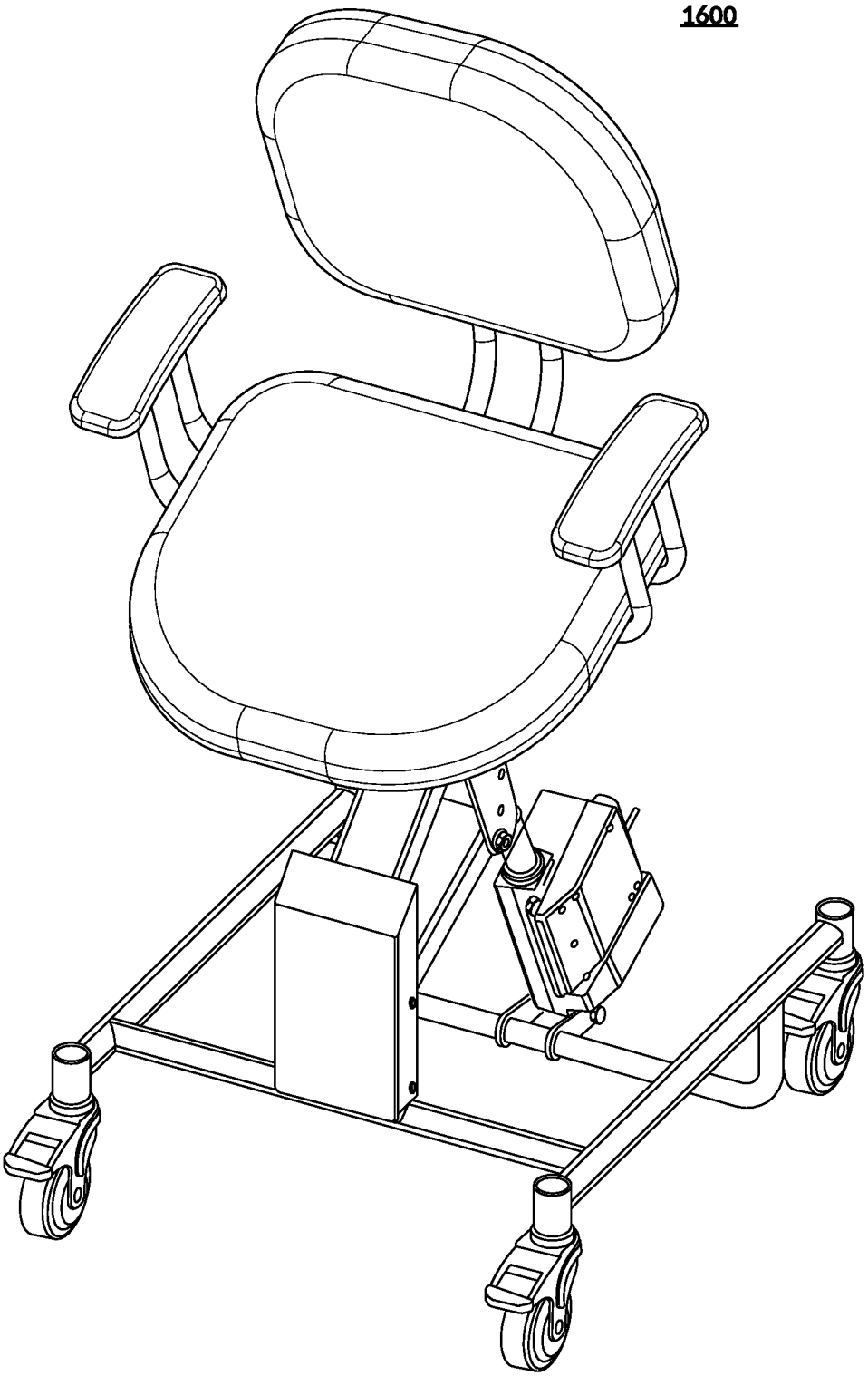
FIG. 30 is a perspective view of a raised elevated seat in accordance with respective examples.
Figure 31:
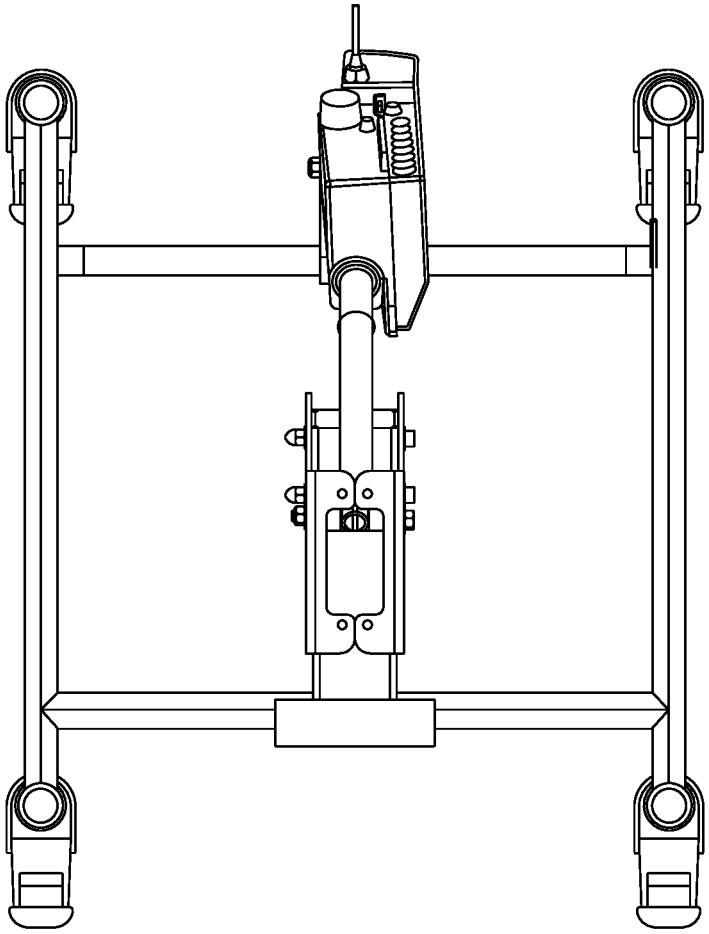
FIG. 31 is a back perspective view of a raised bottom portion of an elevated seat in accordance with respective examples.
Figure 32:
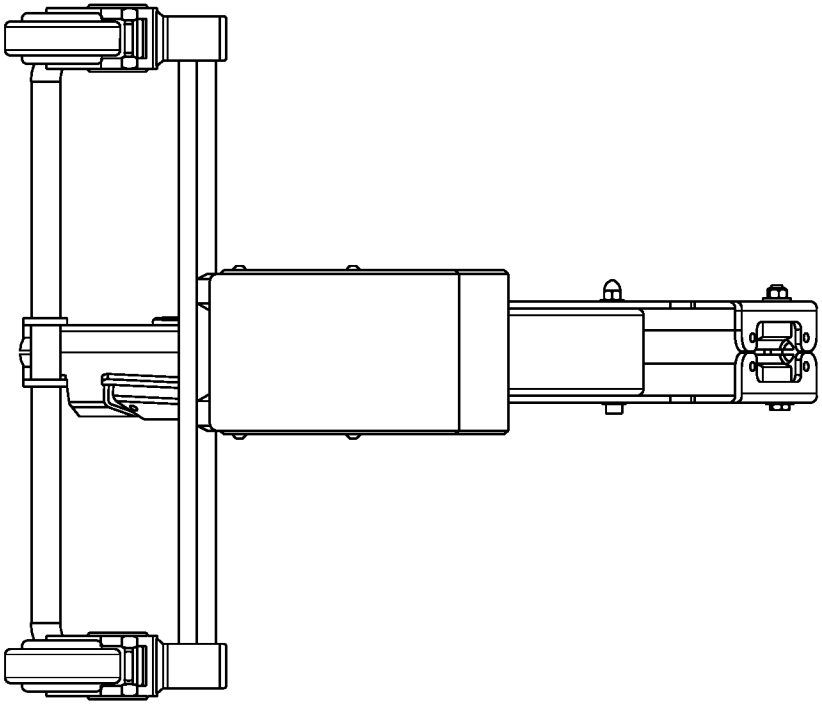
FIG. 32 is a front perspective view of a raised bottom portion of an elevated seat in accordance with respective examples.
Figure 33:
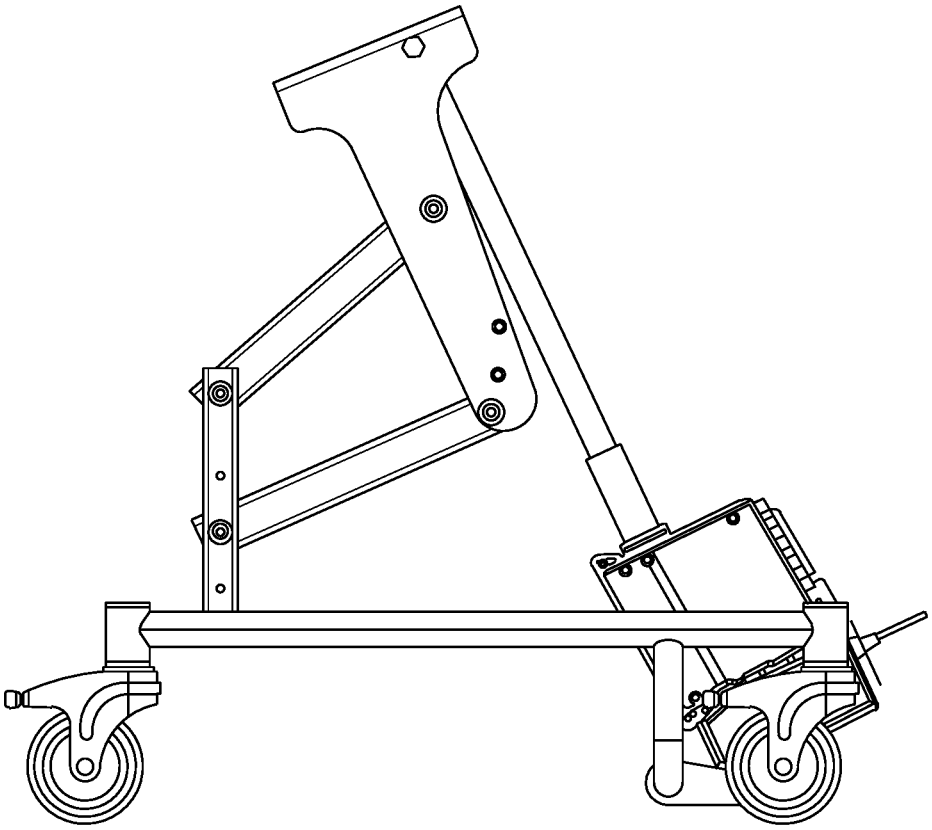
FIG. 33 is a side perspective view of a raised bottom portion of an elevated seat in accordance with respective examples.
Figure 34:
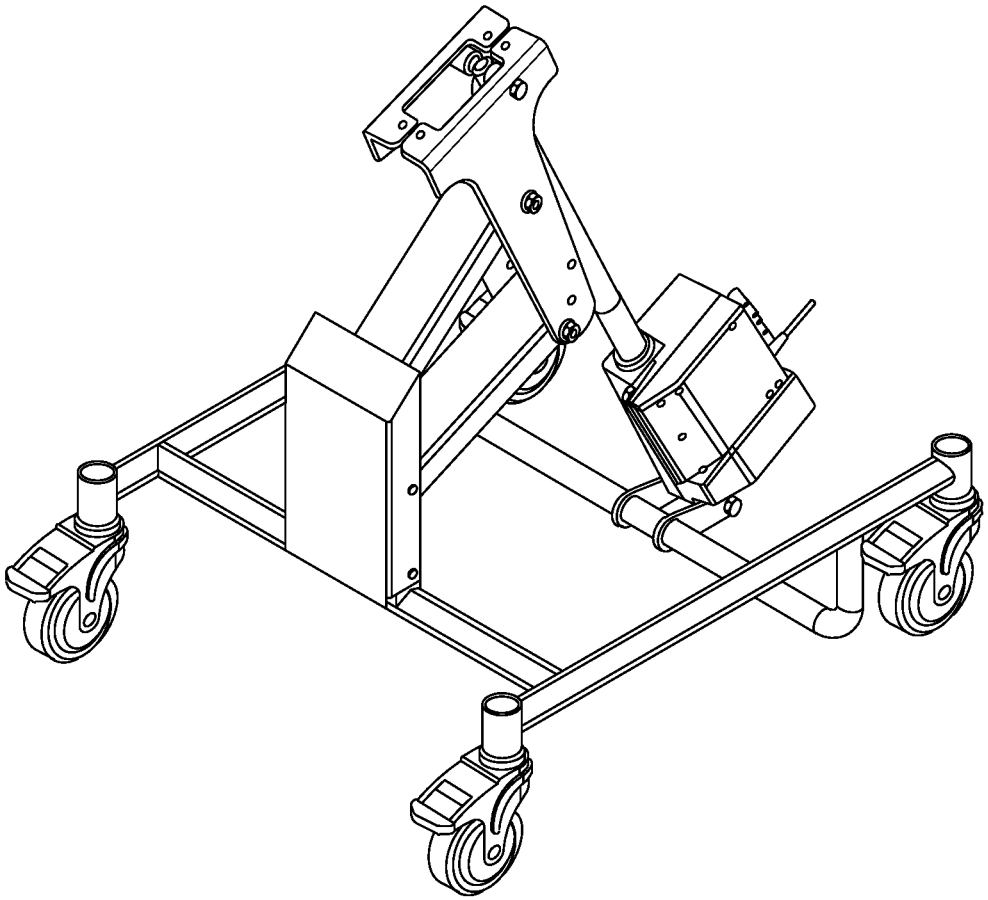
FIG. 34 is a perspective view of a raised bottom portion of an elevated seat in accordance with respective examples.
Figure 35:
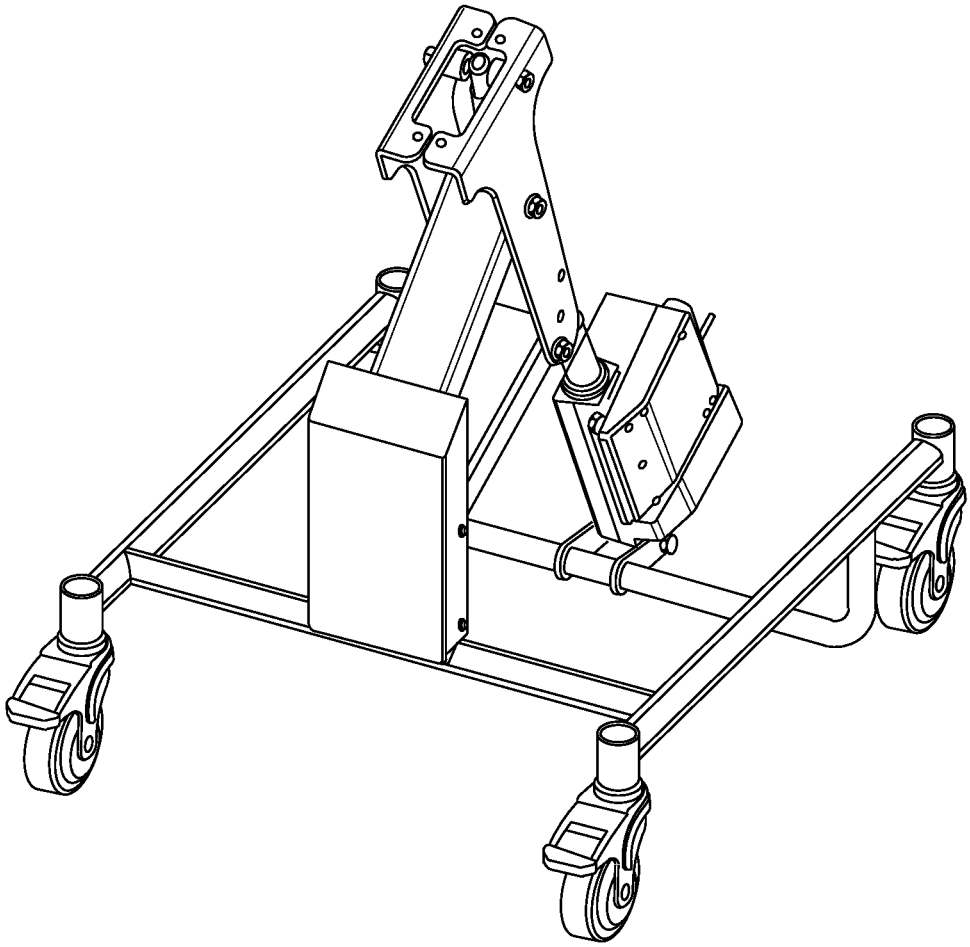
FIG. 35 is a perspective view of a raised bottom portion of an elevated seat in accordance with respective examples.

FIG. 19 illustrates a perspective view of a lowered seat in accordance with respective examples. The vertical support 1612 as shown has three position holes. The three position holes 1610, 1710, and 1810 can be seen in FIG. 18 and FIG. 19. Other examples may include more or less position holes. For example, the vertical support 1612 may include two or four position holes. The position hole 1610 corresponds with the smallest lift angle. The lift angle is the angle between a plane parallel to the base 1640 and the seat portion 1650 when the seat is in its raised position. The other position holes 1710 and 1810 correspond to larger lift angles. In one example, the position holes 1610, 1710, and 1810 correspond to lift angles of 3 degrees, 14 degrees, and 20 degrees, respectively. Other lift angels are also possible. The lift angle for position hole 1610 may correspond to a lift angle between 0 and 10 degrees. The lift angle for position hole 1710 may correspond to a lift angle between 8 and 18 degrees. The lift angle for position hole 1810 may correspond to a lift angle between 12 and 22 degrees. The vertical support 1612 may attached to the elongate member 1620 via a pin, safety pin with locking wiring, etc. The seat 1600 may be configured to use any of the position holes and such selection may change over time and use of the seat 1600.

FIGS. 26-30 illustrate various perspectives of a raised elevated seat in accordance with respective examples. In the illustrated configuration, the position hole 1810 is used such that the raise seat portion 1650 is elevated to a lift angle of 14 degrees. FIGS. 31-35 illustrate various perspective views of a raised bottom portion of an elevated seat, with out the seat portion 1650, in accordance with respective examples. The example seat illustrated in FIG. 31 has a single lift generator. In other examples, two lift generators may be used. For example, the lift generators may be installed to each provide a force to the sides of the seat portion 1650 rather than near the center of the seat portion 1650 when a single lift generator is used.

Similar to the described seat 100, the seat 1600 may include a control to raise and lower the seat. The control may be attached to the seat portion or integrated into one or both of the handles. For example, a raise button may be integrated into one handle and a lower button may be integrated into another handle. As another example, the control may be foot operated. For example, the control may be connected to the base of the seat. The foot control may include two foot-operated controls to raise and lower the seat.

Various components of the described seats, such as the supports, base, elongate members, and extension portions may be made of various rigid materials such as steel, aluminum, plastic, etc.

The above description is intended to be illustrative, and not restrictive. For example, the above-described examples (or one or more aspects thereof) may be used in combination with others. Other embodiments may be used, such as by one of ordinary skill in the art upon reviewing the above description. Further, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

What is claimed is:

1. A device for seat elevation, the device comprising:

a base;

a seat portion, wherein in a seated position the seat portion is at a first angle, wherein in a lifted position the seat portion is at a lifted angle, and wherein the lifted angle is formed by the seat portion and a plane parallel to the base;

a first vertical support attached to the base;

a second vertical support attached to the horizontal seat portion, wherein the second vertical support comprises at least two seat position holes, and wherein each of the at least two seat position holes has a corresponding lifted angle;

a third vertical support attached to the horizontal seat portion opposite of the second vertical support, wherein the third vertical support comprises at least two seat position holes corresponding to the at least two seat position holes of the second vertical support;

a first elongate member pivotally connected to the first vertical support and the second vertical support, wherein the first elongate member is attached to the second vertical support via a first one of the at least two seat position holes of the second vertical support, wherein the first elongate member is configurable to attach to a second one of the at least two seat position holes of the second vertical support, wherein the lifted angle is determined by the first one of the at least two seat position holes;

the first elongate member also pivotally connected to the third vertical support, wherein the first elongate member is attached to the third vertical support via a first one of the at least two seat position holes of the third vertical support corresponding to the first one of the at least two seat position holes of the second vertical support, wherein the first elongate member is configurable to attach to a second one of the at least two seat position holes of the third vertical support; and a lift generator attached to the base, wherein the lift generator extends to lift the horizontal seat portion into the lifted position, wherein the lift generator contracts to return the horizontal seat portion to the seated position.

2. The device of claim 1, wherein the first angle is between the seat portion and a plane parallel to the base, and wherein the first angle is zero degrees.

3. The device of claim 1, wherein the lifted angle is between 1 degree and 10 degrees.

4. The device of claim 3, wherein the lifted angle is 3 degrees.

5. The device of claim 1, wherein the second vertical support comprises three seat position holes.

6. The device of claim 5, wherein a middle seat position hole corresponds with the lifted angle between 8 degrees and 18 degrees.

7. The device of claim 6, wherein the lifted angle corresponding to the middle seat position hole is 14 degrees.

8. The device of claim 5, wherein a lower seat position hole corresponds with the lifted angle between 12 degrees and 25 degrees.

9. The device of claim 8, wherein the lifted angle corresponding to the lower seat position hole is 20 degrees.

10. The device of claim 1, further comprising a second lift generator attached to the base.

11. The device of claim 1, further comprising a controller configured to operate the lift generator between the seated position and the lifted position.

12. The device of claim 11, wherein the controller is attached to the base.

13. The device of claim 1, further comprising:

at least four wheels each attached to the base; and at least two-wheel locks configured to prevent at least two of the at least four wheels from moving when in a locked position.

14. The device of claim 1, wherein the second vertical member and third vertical member are attached to a center portion of the seat portion.

15. The device of claim 1, further comprising a back support portion.

16. The device of claim 1, further comprising a first arm rest and an opposing second arm rest.

17. The device of claim 1, wherein the lift generator is connected centrally to the seat portion.

18. The device of claim 1, further comprising a second elongate member connected to the first vertical support, the second vertical support, and the third vertical support.

* * * * *